US005529896A

United States Patent [19]

Hioki et al.

[11] Patent Number: 5,529,896

[45] Date of Patent: Jun. 25, 1996

[54] SILVER HALIDE PHOTOGRAPHIC MATERIAL

[75] Inventors: Takanori Hioki; Tadashi Ikeda, both of Kanagawa, Japan

[73] Assignee: Fuji Photo Film Co., Ltd., Kanagawa, Japan

[21] Appl. No.: 264,066

[22] Filed: Jun. 22, 1994

[30] Foreign Application Priority Data

Jun. 22, 1993 [JP] Japan ..... 5-173573

[51] Int. Cl.[6] ..... G03C 1/005; G03C 1/494

[52] U.S. Cl. ..... 430/572; 430/599; 430/607; 430/576; 430/581; 430/584; 430/585; 430/588; 430/598

[58] Field of Search ..... 430/572, 599, 430/607, 576, 581, 584, 585, 588, 598

[56] References Cited

U.S. PATENT DOCUMENTS

| | | | |
|---|---|---|---|
| 2,423,710 | 5/1944 | Knott | 430/570 |
| 3,615,533 | 10/1971 | Rauner et al. | 430/572 |
| 4,725,532 | 2/1988 | Kameoka et al. | 430/581 |
| 5,093,222 | 3/1992 | Katoh | 430/572 |

FOREIGN PATENT DOCUMENTS

| | | |
|---|---|---|
| 0367227 | 5/1990 | European Pat. Off. . |
| 2003646 | 11/1969 | France . |

OTHER PUBLICATIONS

Patent Abstracts of Japan, Silver Halide Photographic Material for Forming Direct Positive Image, vol. 4, No. 66 (p-11) [548] May 17, 1980.

*Primary Examiner*—Charles L. Bowers, Jr.
*Assistant Examiner*—Geraldine Letscher
*Attorney, Agent, or Firm*—Sughrue, Mion, Zinn, Macpeak & Seas

[57] ABSTRACT

A silver halide photographic material comprising a support having thereon at least one silver halide emulsion layer, wherein the layer contains at least one compound represented by the following formula (I) and at least one compound represented by the following formula (X):

(I)

wherein $R_1$, $R_2$ and $R_3$ are the same or different and each represents a substituted or unsubstituted aliphatic group, a substituted or unsubstituted aryl group or a substituted or unsubstituted heterocyclic group; $R_4$ represents a hydrogen atom, a substituted or unsubstituted alkyl group, a substituted or unsubstituted aryl group or a substituted or unsubstituted heterocyclic group; and $R_1$ and $R_2$, and $R_3$ and $R_4$ each may be combined with each other to form a ring;

(X)

wherein $Z_{11}$ represents a sulfur atom, a selenium atom or a substituted nitrogen atom represented by in which $R_{13}$ represents a substituted or unsubstituted alkyl group, a substituted or unsubstituted aryl group or a substituted or unsubstituted heterocyclic group; $Z_{12}$ represents a sulfur atom, a selenium atom, an oxygen atom or a substituted nitrogen atom represented by in which $R_{13a}$ has the same meaning as $R_{13}$; $R_{11}$ and $R_{12}$ are the same or different and each represents a substituted or unsubstituted alkyl group; $V_{11}$, $V_{12}$, $V_{13}$, $V_{14}$, $V_{15}$, $V_{16}$, $V_{17}$ and $V_{18}$ are the same or different and each represents a hydrogen atom or a monovalent substituent; and adjacent two substituents thereof may be combined with each other to form a ring; $L_{11}$, $L_{12}$ and $L_{13}$ are the same or different and each represents a substituted or unsubstituted methine group; $n_{11}$ represents 1, 2 or 3; $M_{11}$ represents a counter ion for neutralizing charge; and $m_{11}$ is a number of 0 or more necessary for neutralizing the molecular charge.

13 Claims, No Drawings

SILVER HALIDE PHOTOGRAPHIC MATERIAL

FIELD OF THE INVENTION

The present invention relates to a silver halide photographic material, and more particularly to a silver halide photographic material improved in fluctuations of photographic sensitivity with printing temperature and photographic sensitivity during storage.

BACKGROUND OF THE INVENTION

Silver halide photographic materials indicate variations in photographic sensitivity with changes in temperature on exposure, or printing temperature dependency, which is one problem in using. An improvement in fluctuations of photographic sensitivity during storage has also hitherto been desired.

Previously, as to compounds similar to those represented by formula (I) of the present invention described hereinafter, the use thereof as precursors has been disclosed in JP-A-61-196240 (the term "JP-A" as used herein means an "unexamined published Japanese patent application"), the use thereof as ultraviolet absorbers in European Patent 40,583, the use thereof as color sensitizers in U.S. Pat. No. 3,615,533, the use thereof as stabilizers in U.S. Pat. No. 3,549,371, and the use thereof as supersensitizers for 2'-cyanine and oxacarbocyanine in U.S. Pat. No. 2,423,710. It has not been known at all, however, that hydrazones having the specified structure used in the present invention improve exposure temperature dependency of silver halide photographic materials spectrally sensitized with spectrally sensitizing dyes having the specified structure in the present invention, and that they improve storage stability.

SUMMARY OF THE INVENTION

An object of the present invention is to improve fluctuations of photographic sensitivity with printing temperature of a silver halide photographic material spectrally sensitized with a specified color sensitizing dye, and further to improve the deviations of photographic sensitivity thereof during storage.

This and other objects of the present invention can be achieved by a silver halide photographic material comprising a support having thereon at least one silver halide emulsion layer, wherein the layer contains at least one compound represented by the following formula (I) and at least one compound represented by the following formula (X). Preferably, the above-described silver halide photographic material is spectrally sensitized with the compound represented by formula (X).

Formulae (I) and (X) are as follows:

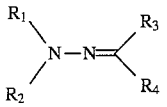

(I)

wherein $R_1$, $R_2$ and $R_3$ are the same or different and each represents a substituted or unsubstituted aliphatic group, a substituted or unsubstituted aryl group or a substituted or unsubstituted heterocyclic group; $R_4$ represents a hydrogen atom, a substituted or unsubstituted alkyl group, a substituted or unsubstituted aryl group or a substituted or unsubstituted heterocyclic group; and $R_1$ and $R_2$, and $R_3$ and $R_4$ each may be combined with each other to form a ring;

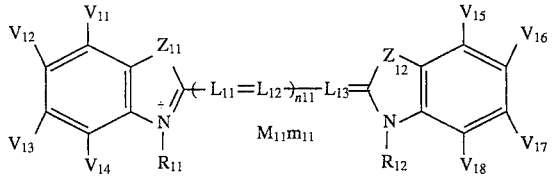

(X)

wherein $Z_{11}$ represents a sulfur atom, a selenium atom or a substituted nitrogen atom represented by

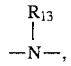

in which $R_{13}$ represents a substituted or unsubstituted alkyl group, a substituted or unsubstituted aryl group or a substituted or unsubstituted heterocyclic group; $Z_{12}$ represents a sulfur atom, a selenium atom, an oxygen atom or a substituted nitrogen atom represented by

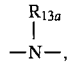

in which $R_{13a}$ has the same meaning as $R_{13}$; $R_{11}$ and $R_{12}$ are the same or different and each represents a substituted or unsubstituted alkyl group; $V_{11}$, $V_{12}$, $V_{13}$, $V_{14}$, $V_{15}$, $V_{16}$, $V_{17}$ and $V_{18}$ are the same or different and each represents a hydrogen atom or a monovalent substituent; and adjacent two substituents thereof may be combined with each other to form a ring; $L_{11}$, $L_{12}$ and $L_{13}$ are the same or different and each represents a substituted or unsubstituted methine group; $n_{11}$ represents 1, 2 or 3; $M_{11}$ represents a counter ion for neutralizing charge; and $m_{11}$ is a number of 0 or more necessary for neutralizing the molecular charge.

Preferably, the compound represented by formula (I) is represented by the compound represented by the following formula (II):

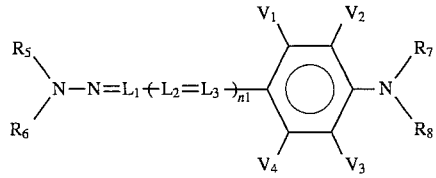

(II)

wherein $R_5$ and $R_6$ are the same or different and each has the same meanings as $R_1$ and $R_2$; $R_7$ and $R_8$ are the same or different and each represents a hydrogen atom, a substituted or unsubstituted alkyl group, a substituted or unsubstituted aryl group or a substituted or unsubstituted heterocyclic group; $V_1$, $V_2$, $V_3$ and $V_4$ are the same or different and each represents a hydrogen atom or a monovalent substituent; $L_1$, $L_2$ and $L_3$ are the same or different and each represents a substituted or unsubstituted methine group; and $n_1$ represents 0 or 1.

DETAILED DESCRIPTION OF THE INVENTION

Formula (I) will be illustrated in more detail below. The aliphatic groups represented by $R_1$, $R_2$ and $R_3$ include saturated or unsaturated aliphatic groups and straight chain, branched or cyclic aliphatic groups. Specific examples of $R_1$, $R_2$ and $R_3$ include an unsubstituted aliphatic group (preferably one having from 1 to 38 carbon atoms, for example, methyl, ethyl, propyl, isopropyl, butyl, isobutyl, hexyl, octyl, dodecyl, octadecyl, cyclopentyl, cyclopropyl and cyclohexyl); and a substituted aliphatic group [preferably one having from 1 to 38 total carbon atoms, and when the substituent is represented by V, V is not particularly limitated, and examples thereof include a carboxyl group, a sulfo group, a cyano group, a halogen atom (for example, fluorine, chlorine, bromine, iodine), a hydroxyl group, an alkoxycarbonyl group (for example, methoxycarbonyl, ethoxycarbonyl, phenoxycarbonyl, benzyloxycarbonyl), an alkoxy group (for example, methoxy, ethoxy, benzyloxy, phenetyloxy), an aryloxy group having from 6 to 18 carbon atoms (for example, phenoxy, 4-methylphenoxy, 1-naphthoxy), an acyloxy group (for example, acetyloxy, propionyloxy), an acyl group (for example, acetyl, propionyl, benzoyl, mesyl), a carbamoyl group (for example, carbamoyl, N,N-dimethylcarbamoyl, morpholinocarbonyl, piperidinocarbonyl), a sulfamoyl group (for example, sulfamoyl, N,N-dimethylsulfamoyl, morpholinosulfonyl, piperidinosulfonyl), an aryl group (for example, phenyl, 4-chlorophenyl, 4-methylphenyl, 1-naphthyl), a heterocyclic group (for example, 2-pyridyl, tetrahydrofurfuryl, morpholino, 2-thiopheno), an amino group (for example, amino, dimethylamino, anilino, diphenylamino), an alkylthio group (for example, methylthio, ethylthio), an alkylsulfonyl group (for example, methylsulfonyl, propylsulfonyl), an alkylsulfinyl group (for example, methylsulfinyl), a nitro group, a phosphoric acid group, an acylamino groups (for example, acetylamino), an ammonium group (for example, trimethylammonium, tributylammonium), a mercapto group, a hydrazino group (for example, trimethylhydrazino), a ureido group (for example, ureido, N,N-dimethylureido), an imido group and an unsaturated hydrocarbon group (for example, vinyl, ethynyl, 1-cyclohexenyl)]. It is preferred that substituents V each has from 0 to 18 carbon atoms, and they may be further substituted by one or more of the substituents represented by V.

More specifically, examples of V include a carboxymethyl group, a 2-carboxyethyl group, a 3-carboxypropyl group, a 4-carboxybutyl group, a 2-sulfoethyl group, a 3-sulfopropyl group, a 4-sulfobutyl group, a 3-sulfobutyl group, a 2-hydroxy-3-sulfopropyl group, a 2-cyanoethyl group, a 2-chloroethyl group, a 2-bromoethyl group, a 2-hydroxyethyl group, a 3-hydroxypropyl group, a hydroxymethyl group, a 2-hydroxyethyl group, a 2-methoxyethyl group, a 2-ethoxyethyl group, a 2-ethoxycarbonylethyl group, a methoxycarbonylmethyl group, a 2-methoxyethyl group, a 2-ethoxyethyl group, a 2-phenoxyethyl group, a 2-acetyloxyethyl group, a 2-propionyloxyethyl group, a 2-acetylethyl group, a 3-benzoylpropyl group, a 2-carbamoylethyl group, a 2-morpholinocarbonylethyl group, a sulfamoylmethyl group, a 2-(N,N-dimethylsulfamoyl)ethyl group, a benzyl group, a 2-naphthylethyl group, a 2-(2-pyridyl)ethyl group, an allyl group, a 3-aminopropyl group, a 3-dimethylaminopropyl group, a methylthiomethyl group, a 2-methylsulfonylethyl group, a methylsulfinylmethyl group, a 2-acetylaminoethyl group, a 3-trimethylammoniumethyl group, a 2-mercaptoethyl group, a 2-trimethylhydrazinoethyl group, a methylsulfonylcarbamoylmethyl group and a (2-methoxy-)ethoxymethyl group. Further, examples of $R_1$, $R_2$ and $R_3$ include an unsubstituted aryl group (for example, phenyl, 1-naphthyl, 2-naphthyl), a substituted aryl group (for example, phenyl, naphthyl substituted by one or more of the above-described substituents V), an unsubstituted heterocyclic group. (for example, 2-pyridyl, 2-thiazolyl) and a substituted heterocyclic group (for example, 2-pyridyl substituted by one or more of the above-described substituents V).

$R_1$ and $R_2$, and $R_3$ and $R_4$ each may be combined with each other to form a ring. These rings may be substituted by one or more of the above-described substituents V.

Further, as a matter of course, the alkyl groups represented by $R_1$ and $R_2$ do not include a group which is bonded through $$-\overset{O}{\overset{\|}{C}}-,\ -\overset{S}{\overset{\|}{C}}-,\ \text{or}\ -\overset{N}{\overset{\|}{C}}-.$$

For example, $R_1$ and $R_2$ are each not an acetyl group, a carboxyl group, a benzoyl group, a formyl group, a thioacetyl group, a thioaldehyde group, a thiocarboxyl group, a thiobenzoyl group, an imino group, an N-methylimino group and an N-phenylimino group, and when $R_1$ and $R_2$ are combined with each other to form a ring, it cannot be a malonyl group, a succinyl group, a glutaryl group and an adipoyl group.

$R_1$ and $R_2$ are each preferably the above-described unsubstituted or substituted alkyl group.

$R_1$ and $R_2$ are each more preferably an unsubstituted alkyl group (one having preferably from 1 to 18, more preferably from 1 to 8, carbon atoms, for example, methyl, ethyl, propyl, butyl), and a substituted alkyl group (one having preferably from 1 to 18, more preferably from 1 to 8, total carbon atoms, for example, a sulfoalkyl group such as 2-sulfoethyl, 3-sulfopropyl, 4-sulfobutyl and 3-sulfobutyl; a carboxyalkyl group such as carboxymethyl and 2-carboxyethyl; and a hydroxyalkyl group such as 2-hydroxyethyl).

$R_3$ is more preferably a substituent represented by the following formula (III):

$$\text{-}(L_4=L_5)_{n_2}\text{-}Ar \qquad \text{(III)}$$

wherein $L_4$ and $L_5$ each represents a substituted or unsubstituted methine group; Ar represents a substituted or unsubstituted aryl group; and $n_2$ represents an integer of 0 or more.

Ar is preferably a phenyl group or a substituted phenyl group (the substituents include $R_1$, $R_2$, $R_3$ and V described above).

$L_4$ and $L_5$ are preferably an unsubstituted methine group.

$n_2$ is preferably 0 or 1, more preferably 1.

$R_4$ represents a hydrogen atom or the same substituents as $R_1$, $R_2$ and $R_3$ described above.

$R_4$ is preferably a hydrogen atom.

The hydrazone compounds represented by formula (I) may be isolated as salts thereof, when the salts are advantageous in synthesis and storage. In such case, any compound may be used, so long as it can form salts with the hydrazones. Preferred examples of the salts include arylsulfonates (for example, p-toluenesulfonate, p-chlorobenzenesulfonate), aryldisulfonates (for example, 1,3-benzenedisulfonate, 1,5-naphthalenedisulfonates, 2,6-naphthalenedisulfonate), thiocyanates, picrates, carboxylates (for example, oxalate, acetate, benzoate and hydrogen-oxalate), hydrohalogenates (for example, hydrochloride, hydrofluoride, hydrobromide, hydroiodide), sulfates, perchlorates, tetrafluoroborates, sulfites, nitrates, phosphates, carbonates and bicarbonates.

Of these, hydrogenoxalates, oxalates and hydrochlorides are preferred.

Formula (II) will be illustrated in more detail below. $R_5$ and $R_6$ have the same meanings as $R_1$ and $R_2$ described above, and preferred examples of $R_5$ and $R_6$ are the same groups as those of $R_1$ and $R_2$.

$R_7$ and $R_8$ are each preferably a hydrogen atom or the same alkyl, aryl or heterocyclic groups as those of $R_1$ and $R_2$.

$R_7$ and $R_8$ are each more preferably an unsubstituted or substituted alkyl group, and most preferably an unsubstituted alkyl group having from 1 to 8 carbon atoms (for example, methyl, ethyl, propyl, butyl), and a substituted alkyl group having from 1 to 8 total carbon atoms (for example, a sulfoalkyl group such as 2-sulfoethyl, 3-sulfopropyl, 4-sulfobutyl, 3-sulfobutyl; a carboxyalkyl group such as carboxymethyl and 2-carboxyethyl; and a hydroxyalkyl group such as 2-hydroxyethyl).

$V_1$, $V_2$, $V_3$ and $V_4$ are the same or different and each represents a hydrogen atom or a monovalent substituent. They are not particularly limited, and examples thereof include the substituents exemplified above as $R_1$, $R_2$, $R_3$ and V. Preferably, $V_1$, $V_2$, $V_3$ and $V_4$ are each an unsubstituted alkyl group having from 1 to 4 carbon atoms (for example, methyl, ethyl), a substituted alkyl group having from 1 to 6 total carbon atoms (for example, 2-sulfobutyl, 2-carboxyethyl), and a substituted or unsubstituted alkoxyl group having from 1 to 4 total carbon atoms (for example, methoxy, ethoxy). $V_1$, $V_2$, $V_3$ and $V_4$ are each more preferably a hydrogen atom, a methyl group or a methoxy group, and most preferably a hydrogen atom.

$L_1$, $L_2$ and $L_3$ are the same or different and each represents an unsubstituted methine group or a substituted methine group (the substituents for the methine group include, for example, the substituents exemplified above as $R_1$, $R_2$, $R_3$ and V). Of these, the unsubstituted methine group is preferred.

$n_1$ is preferably 0.

Formula (X) will be illustrated in more detail below. When $Z_{11}$ or $Z_{12}$ each represents a substituted nitrogen atom, it is represented by

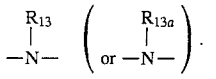

$R_{13}$ and $R_{13a}$ are each preferably the same groups as those of $R_1$, $R_2$ and $R_3$ described above, and more preferably a substituted or unsubstituted alkyl group (for example, methyl, ethyl, ethoxyethyl). $Z_{11}$ is preferably a sulfur atom or a substituted nitrogen atom, and more preferably a sulfur atom.

$Z_{12}$ is a sulfur atom, a selenium atom, a substituted nitrogen atom or an oxygen atom shown in the description of $Z_{11}$, preferably a sulfur atom and a substituted nitrogen atom, and more preferably a sulfur atom.

$V_{11}$ to $V_{18}$ are each preferably a hydrogen atom or the same groups as those of $R_1$, $R_2$, $R_3$ and V described above.

Preferred examples of $R_{11}$ and $R_{12}$ include an unsubstituted alkyl group having from 1 to 18 carbon atoms (for example, methyl, ethyl, propyl, butyl, pentyl, octyl, decyl, dodecyl, octadecyl) and a substituted alkyl group having from 1 to 18 carbon atoms substituted by one or more of the following substituents. Examples of the substituents include a carboxyl group, a sulfo group, a cyano group, a halogen atom (for example, fluorine, chlorine, bromine), a hydroxyl group, an alkoxycarbonyl group having from 2 to 8 carbon atoms (for example, methoxycarbonyl, ethoxycarbonyl, benzyloxycarbonyl), an alkanesulfonylaminocarbonyl group having from 3 to 8 carbon atoms, an acylaminosulfonyl group having from 2 to 8 carbon atoms, an alkoxyl group having from 1 to 8 carbon atoms (for example, methoxy, ethoxy, benzyloxy, phenetyloxy), an alkylthio group having from 1 to 8 carbon atoms (for example, methylthio, ethylthio, methylthioethylthioethyl), an aryloxy group having from 6 to 20 carbon atoms (for example, phenoxy, p-tolyloxy, 1-naphthoxy, 2-naphthoxy), an acyloxy group having 2 or 3 carbon atoms (for example, acetyloxy, propionyloxy), an acylthio group having 2 or 3 carbon atoms (for example, acetylthio, propionylthio), an acyl group having from 2 to 8 carbon atoms (for example, acetyl, propionyl, benzoyl), a carbamoyl group having from 1 to 8 carbon atoms (for example, carbamoyl, N,N-dimethylcarbamoyl, morpholinocarbonyl, piperidinocarbonyl), a sulfamoyl group having from 0 to 8 carbon atoms (for example, sulfamoyl, N,N-dimethylsulfamoyl, morpholinosulfonyl, piperidinosulfonyl), an aryl group having from 6 to 20 carbon atoms (for example, phenyl, 4-chlorophenyl, 4-methylphenyl, 1-naphthyl).

More preferably, $R_{11}$ and $R_{12}$ are each an unsubstituted alkyl group having from 1 to 8 carbon atoms (for example, methyl, ethyl, n-propyl, n-butyl, n-pentyl, n-hexyl), a carboxyalkyl group having from 2 to 8 carbon atoms (for example, 2-carboxyethyl, carboxymethyl) and a sulfoalkyl group having from 1 to 6 carbon atoms (for example, 2-sulfoethyl, 3-sulfopropyl, 4-sulfobutyl, 3-sulfobutyl).

$L_{11}$, $L_{12}$ and $L_{13}$ are the same or different and each represents a methine group or a methine group substituted by one or more of the following substituents. Examples of the substituents for the methine group include a substituted or unsubstituted alkyl group (for example, methyl, ethyl, 2-carboxyethyl), a substituted or unsubstituted aryl group (for example, phenyl, o-carboxyphenyl), a substituted or unsubstituted heterocyclic group (for example, barbituric acid), a halogen atom (for example, chlorine, bromine), an alkoxyl group (for example, methoxy, ethoxy), an amino group (for example, N,N-diphenylamino, N-methyl-N-phenylamino, N-methylpiperadino) and an alkylthio group (for example, methylthio, ethylthio). They may form a ring with another methine group or with an auxochrome.

$L_{11}$, $L_{12}$ and $L_{13}$ constitute trimethine, pentamethine and heptamethine dyes. When $n_{11}$ is 2 or 3, the units of $L_{11}$ an $L_{12}$ are repeated, but the units may be the same or different from each other.

Preferred examples of $L_{11}$, $L_{12}$ and $L_{13}$ are enumerated below.

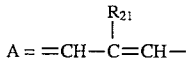

for example,

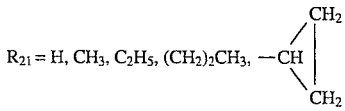

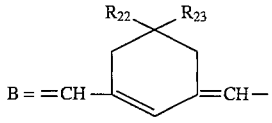

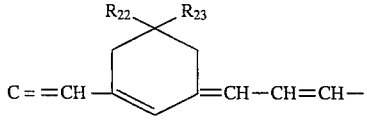

for example, $R_{22} = R_{23} = CH_3$,

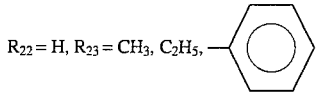

-continued

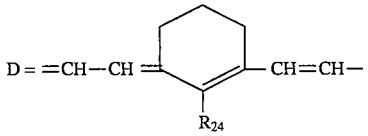

for example, $R_{24}$ = H, $CH_3$,

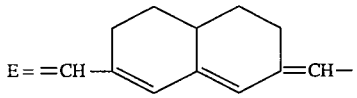

In the above formulae A to E, $R_{21}$, $R_{22}$, $R_{23}$ and $R_{24}$ each represents an alkyl group or an aryl group.

The structures represented by A and B are more preferred, and A is most preferred.

$n_{11}$ is preferably 1 or 2, and more preferably 1.

$(M_{11})m_{11}$ is contained in the formula to denote the presence or absence of a cation or an anion, when neutralization of ionic charge of a dye is required. Whether a certain dye is a cation or an anion, or whether it has net ionic charge, depends upon an auxochrome and a substituent contained. Typical examples of the cations include inorganic and organic ammonium ions (for example, a tetraalkylammonium ion and a pyridinium ion) and an alkali metal ion. On the other hand, the anions may be either of inorganic and organic anions, examples of which include a halogen anion (for example, a fluorine ion, a chlorine ion, a bromine ion, iodine ion), a substituted arylsulfonic acid ion (for example, p-toluenesulfonic acid ion, p-chlorobenzenesulfonic acid ion), an aryldisulfonic acid ion (for example, 1,3-benzenedisulfonic acid ion, 1,5-naphthalenedisulfonic acid ion, 2,6-naphthalenedisulfonic acid ion), an alkylsulfuric acid ion (for example, methylsulfuric acid ion, ethylsulfuric acid ion), a sulfuric acid ion, a thiocyanic acid ion, a perchloric acid ion, a tetrafluoroboric acid ion, a picric acid ion, an acetic acid ion and a trifluoromethanesulfonic acid ion.

Ionic polymers or other dyes having the opposite charge to the dyes may be further employed as a counter ion for neutralizing charge. The use of metal complex ions [for example, bisbenzene-1,2-dithiolatonickel(III)] may be also used.

Preferred examples of the ions include an ammonium ion, an iodine ion and a p-toluenesulfonic acid ion.

Typical examples of the compounds represented by formulae (I) and (II) are enumerated below. However, the scope of this invention should not be limited thereto.

Compounds Represented by Formula (I):

(Compounds represented by formula (I) include compounds represented by formula (II). However, the compounds represented by formula (I) shown herein exclude the compounds represented by formula (II).)

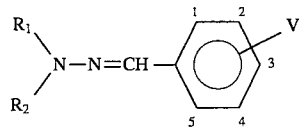

| Compound No. | $R_1$ | $R_2$ | V |
|---|---|---|---|
| (I-1) | $-CH_3$ | $-CH_3$ | $-H$ |
| (I-2) | $-CH_3$ | $-CH_3$ | 3-$OCH_3$ |
| (I-3) | $-CH_3$ | $-CH_3$ | 3-Cl |
| (I-4) | $+(CH_2)_2SO_3Na$ | $-CH_3$ | $-H$ |
| (I-5) | $+(CH_2)_4SO_3Na$ | $-CH_3$ | 1-$CH_3$ |
| (I-6) | $+(CH_2)_3SO_3Na$ | $-CH_3$ | 1-$OCH_3$ |
| (I-7) | $+(CH_2)_2CO_2H$ | $+(CH_2)_2CO_2H$ | 2-$OCH_3$ |
| (I-8) | $+(CH_2)_2CO_2H$ | $-C_2H_5$ | $-H$ |
| (I-9) | $+(CH_2)_3OH$ | $-CH_3$ | 3-$SCH_3$ |
| (I-10) | $+(CH_2)_2CO_2C_2H_5$ | $-CH_3$ | 2-Cl, 4-Cl |
| (I-11) | $+(CH_2)_2CN$ | $-CH_3$ | 1-$CH_3$, 5-$CH_3$ |
| (I-12) | $+(CH_2)_3NHCOCH_3$ | $-CH_3$ | $-H$ |
| (I-13) | $+(CH_2)_2SO_3Na$ | $+(CH_2)_2SO_3Na$ | $-H$ |
| (I-14) | $-CH_3$ | 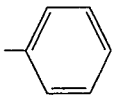 | 3-$OC_2H_5$ |
| (I-15) | 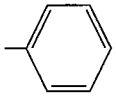 | 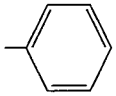 | $-H$ |

-continued
(I-16)
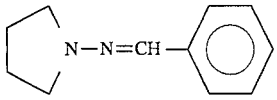
(I-17)
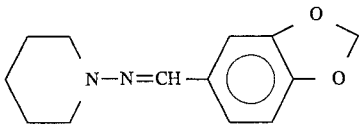
(I-18)
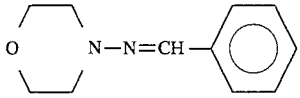
(I-19)
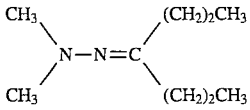
$(CO_2H)_2$
(I-20)
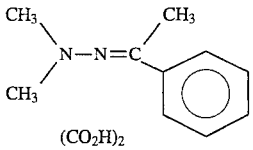
$(CO_2H)_2$
(I-21)
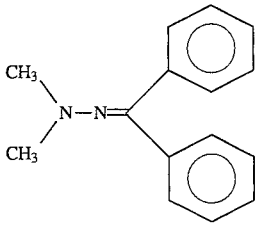
(I-22)
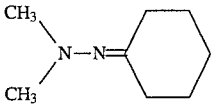
$(CO_2H)_2$
(I-23)
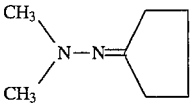
$(CO_2H)_2$
(I-24)
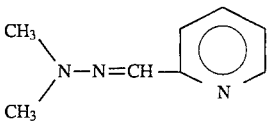
(I-25)
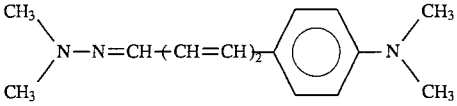
Compounds Represented by Formula (II):
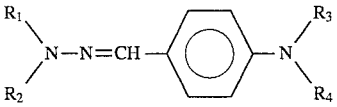
Com-
pound -continued

| No. | $R_1$ | $R_2$ | $R_3$ | $R_4$ |
|---|---|---|---|---|
| (II-1) | $-CH_3$ | $-CH_3$ | $-CH_3$ | $-CH_3$ |
| (II-2) | $-CH_3$ | $-CH_3$ | $-CH_3$ | $+(CH_2)_2OH$ |
| (II-3) | $-CH_3$ | $-CH_3$ | $-CH_3$ | $+(CH_2)_2OC_2H_5$ |
| (II-4) | $-CH_3$ | $-CH_3$ | $-CH_3$ | $-CH_2CO_2H$ |
| (II-5) | $-CH_3$ | $-CH_3$ | $-CH_3$ | $+(CH_2)_2N(CH_3)_3^+I^-$ |
| (II-6) | $-CH_3$ | $-CH_3$ | $-CH_2CO_2H$ | $-CH_2CO_2H$ |
| (II-7) | $-CH_3$ | $-CH_3$ | $-CH_3$ | $+(CH_2)_2SO_3Na$ |
| (II-8) | $-CH_3$ | $-CH_3$ | $-CH_3$ | $+(CH_2)_2Cl$ |
| (II-9) | $-CH_3$ | $-CH_3$ | $-CH_3$ | $-CH_2CN$ |
| (II-10) | $-CH_3$ | $+(CH_2)_2SO_3Na$ | $-CH_3$ | $-CH_3$ |
| (II-11) | $-CH_3$ | $+(CH_2)_2SO_3Na$ | $-CH_3$ | $+(CH_2)_2SO_3Na$ |
| (II-12) | $+(CH_2)_2SO_3Na$ | $+(CH_2)_2SO_3Na$ | $-CH_3$ | $-CH_3$ |
| (II-13) | $-CH_3$ | $+(CH_2)_3OH$ | $-CH_3$ | $-CH_3$ |
| (II-14) | $-CH_3$ | $+(CH_2)_2CO_2H$ | $-CH_3$ | $-CH_3$ |
| (II-15) | $-CH_3$ | $+(CH_2)_2CN$ | $-CH_3$ | $-CH_3$ |
| (II-16) | $-CH_3$ | $+(CH_2)_3NHCOCH_3$ | $-CH_3$ | $-CH_3$ |
| (II-17) | $-CH_3$ | $+(CH_2)_2CO_2C_2H_5$ | $-CH_3$ | $-CH_3$ |

(II-18)

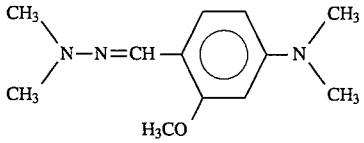

(II-19)

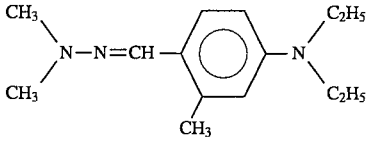

(II-20)

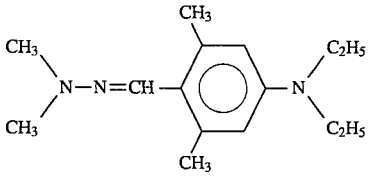

(II-21)

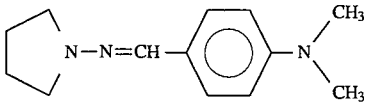

(II-22)

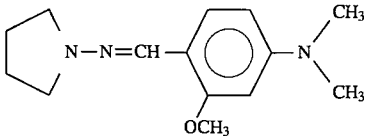

(II-23)

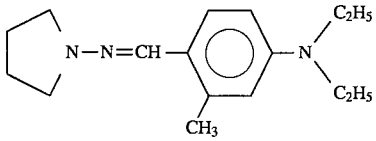

(II-24)

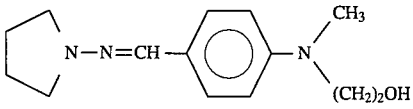

-continued (II-25)

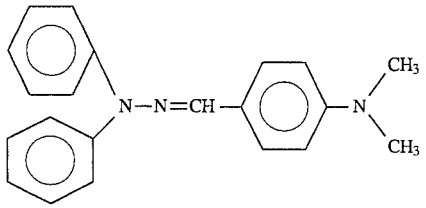

(II-26)

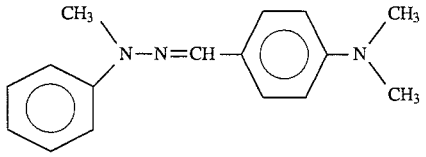

(II-27)

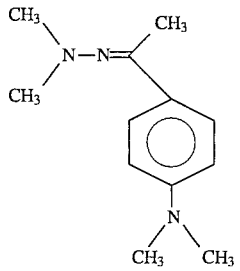

(II-28)

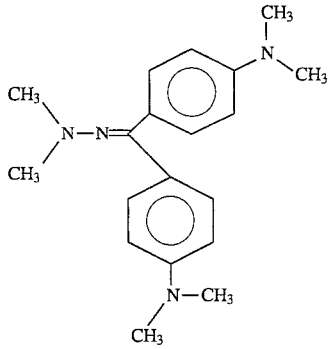

(II-29)

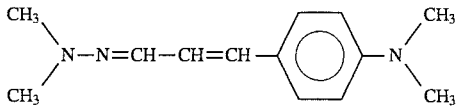

(II-30)

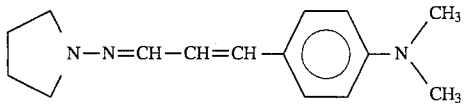

(II-31)

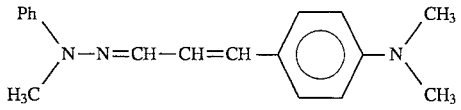

The compounds represented by formula (I) (including formula (II)) can be readily prepared according to known methods, that is, by condensing hydrazones with aldehydes or ketones, in the presence of a small amount of acids (for example, acetic acid, hydrochloric acid) as condensing agents, if necessary. The methods are concretely described in, for example, JP-B-60-34099, JP-B-60-34100 (the term "JP-B" as used herein means an "examined Japanese patent publication").

Typical examples of the sensitizing dyes represented by formula (X) are enumerated below. However, the scope of the present invention is not limited thereto.

Sensitizing Dyes Represented by Formula (X):
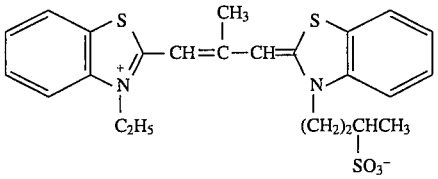
(X-1)
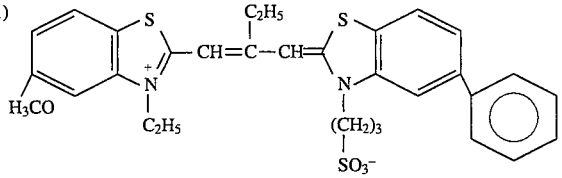
(X-2)
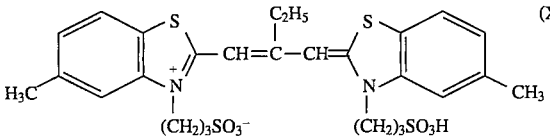
(X-3)
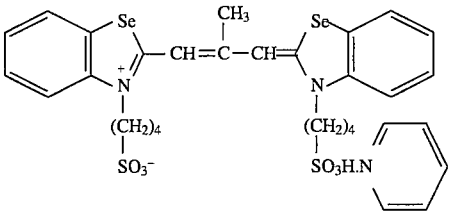
(X-4)
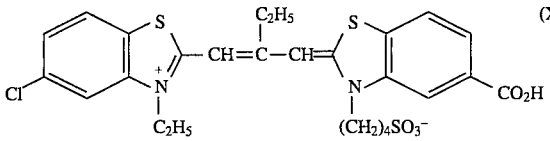
(X-5)
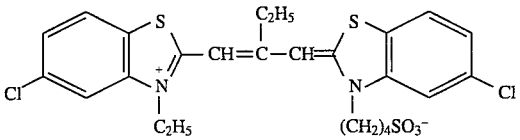
(X-6)
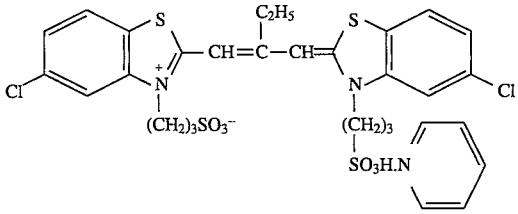
(X-7)
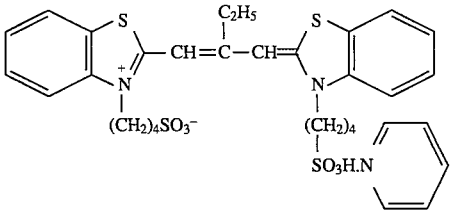
(X-8)
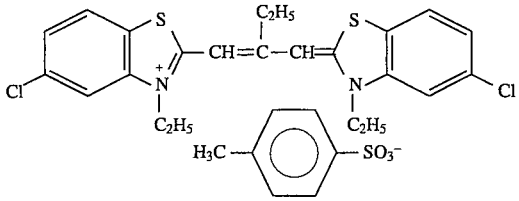
(X-9)
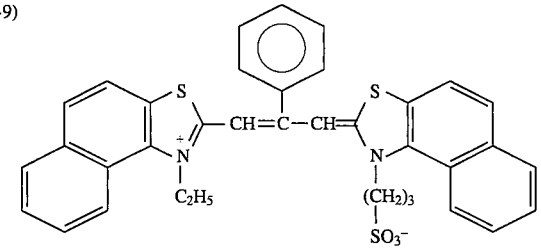
(X-10)
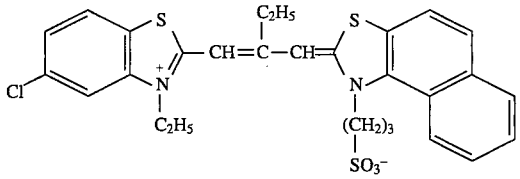
(X-11)
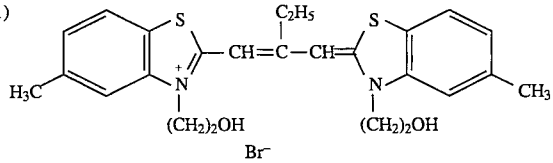
(X-12)
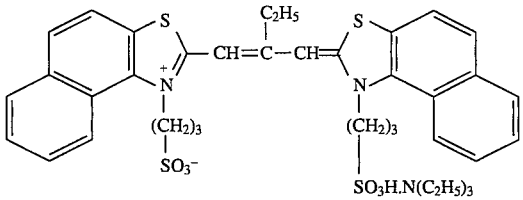
(X-13)
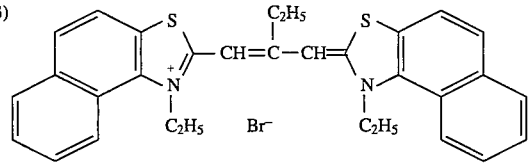
(X-14)
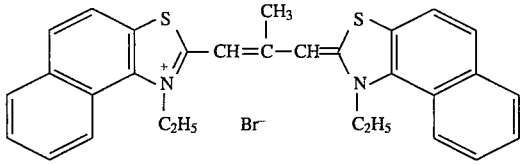
(X-15)
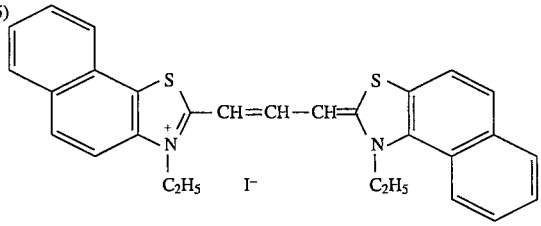
(X-16)

-continued
Sensitizing Dyes Represented by Formula (X):
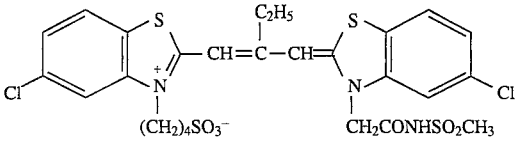
(X-17)
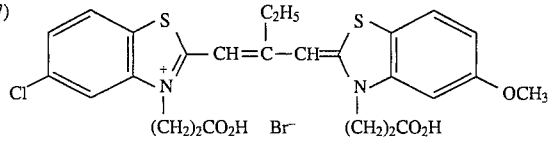
(X-18)
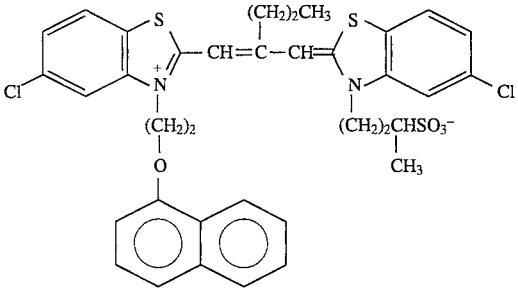
(X-19)
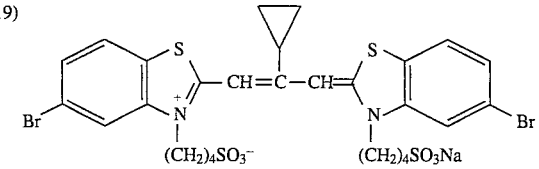
(X-20)
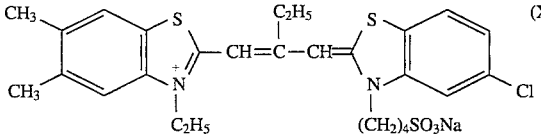
(X-21)
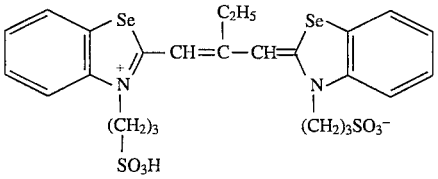
(X-22)
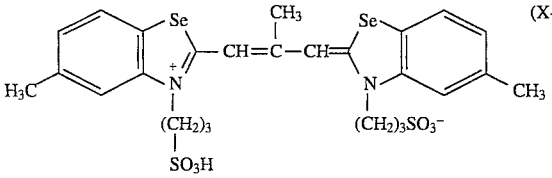
(X-23)
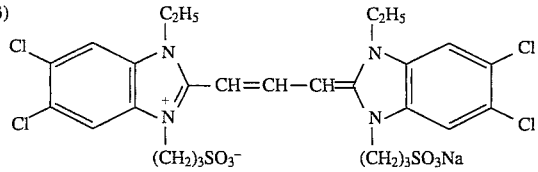
(X-24)
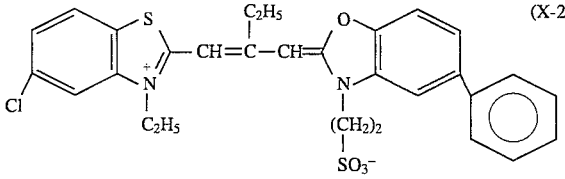
(X-25)
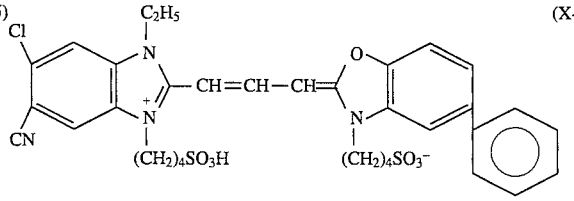
(X-26)
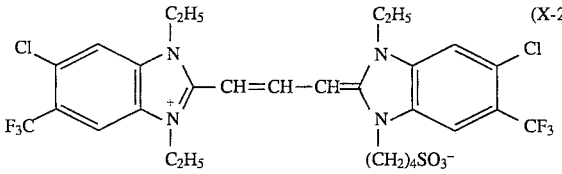
(X-27)
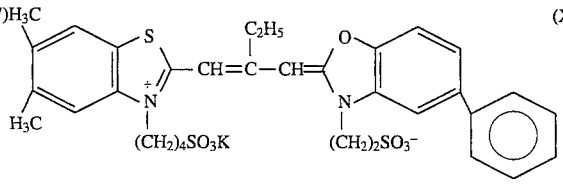
(X-28)
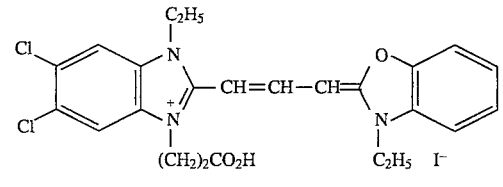
(X-29)
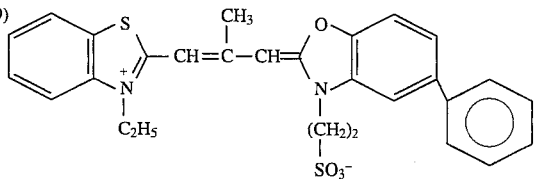
(X-30)
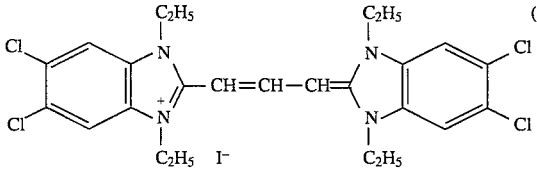
(X-31)
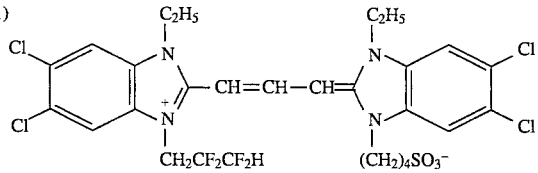
(X-32)

-continued
Sensitizing Dyes Represented by Formula (X):
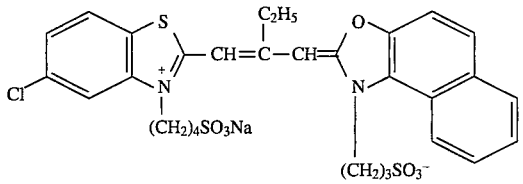
(X-33)
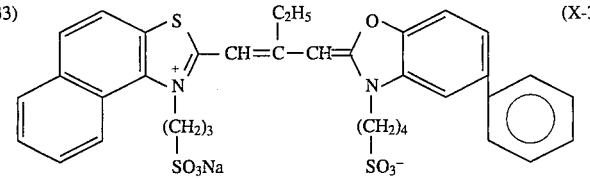
(X-34)
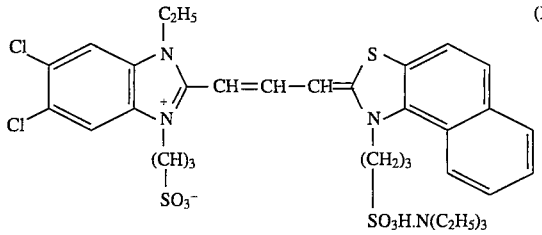
(X-35)
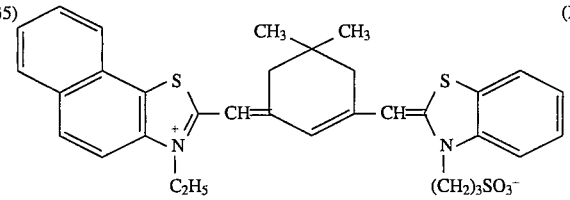
(X-36)
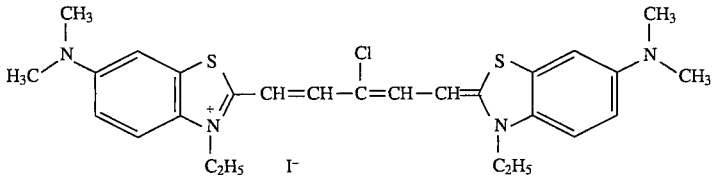
(X-37)
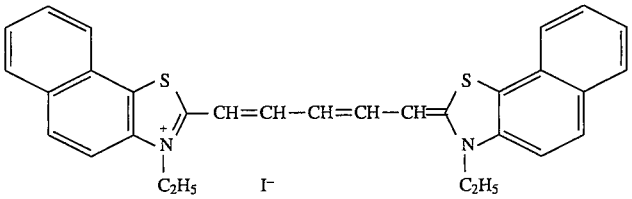
(X-38)
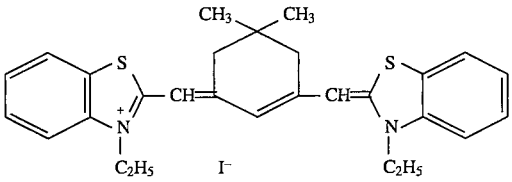
(X-39)
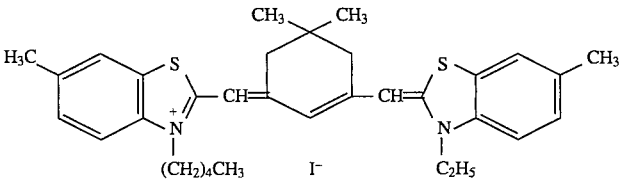
(X-40)
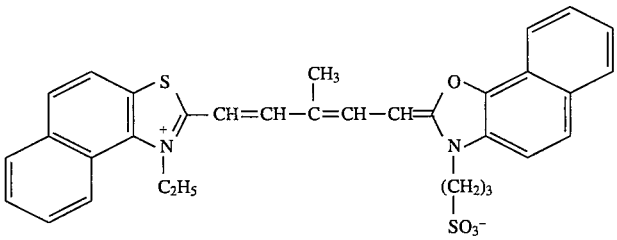
(X-41)

-continued
Sensitizing Dyes Represented by Formula (X):
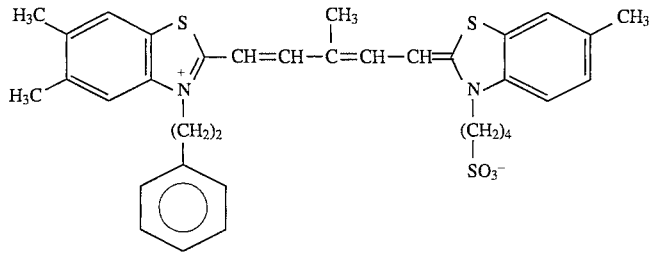
(X-42)
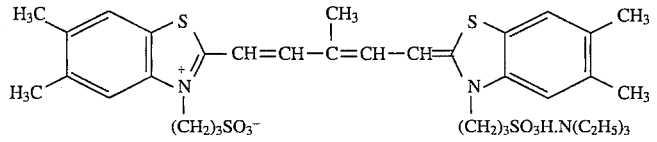
(X-43)
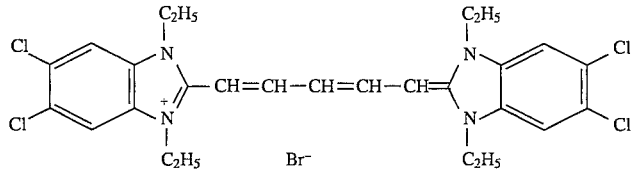
(X-44)
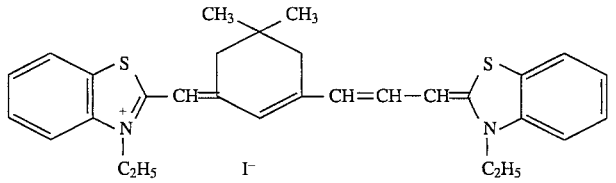
(X-45)
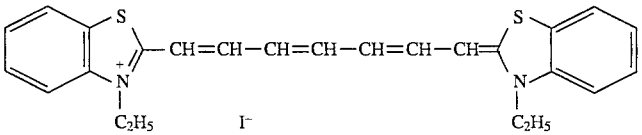
(X-46)
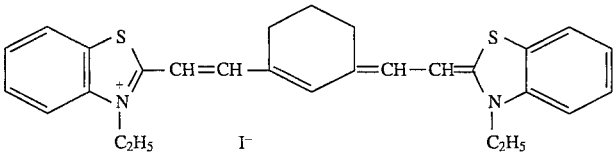
(X-47)
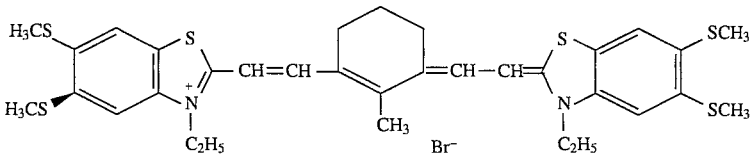
(X-48)
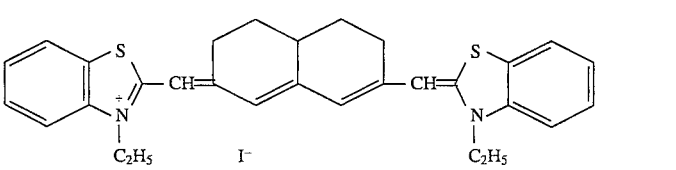
(X-49)

-continued

Sensitizing Dyes Represented by Formula (X):

(X-50)

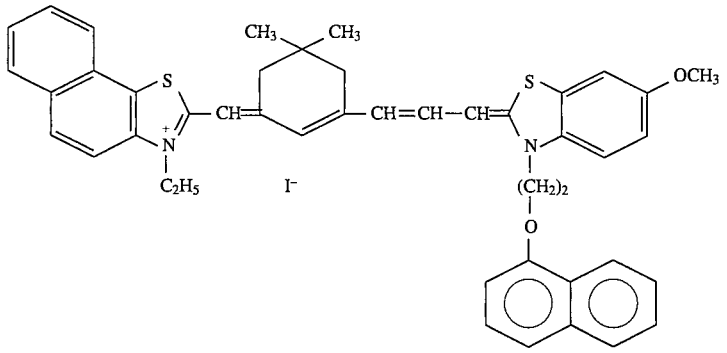

(X-51)

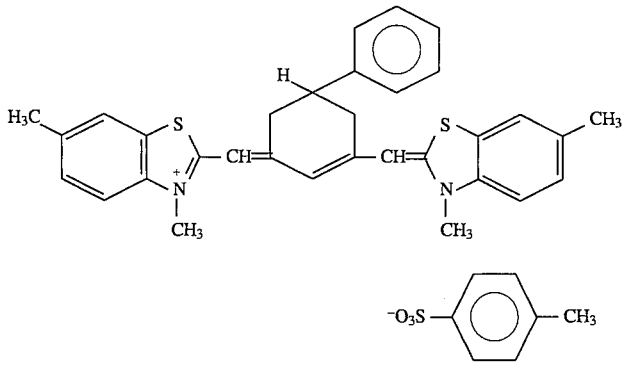

The sensitizing dyes used in the present invention can be synthesized by the methods described in F. M. Hamer, *Heterocyclic Compounds-Cyanine Dyes and Related Compounds* (John & Sons New York London 1964), D. M. Sturmer, *Heterocyclic Compounds-Special Topics in Heterocyclic Chemistry-*, chapter 18, paragraph 14, pp. 482–515 (John Wiley & Sons New York London 1977), and *Rodd's Chemistry of Carbon Compounds,* 2nd ed., vol. IV, part B (1977), chapter 15, pp. 369–422 and 2nd ed., vol. IV, part B (1985), chapter 15, pp. 267–296 (Elsvier Science Publishing Company Inc., New York).

The compounds represented by formula (I) (including formula (II)) of the present invention and the sensitizing dyes represented by formula (X) of the present invention may be directly dispersed in the silver halide emulsions used in the present invention. Alternatively, the compounds and the sensitizing dyes may be dissolved in a solvent such as water, methanol, ethanol, propanol, acetone, methyl cellosolve, 2,2,3,3-tetrafluoropropanol, 2,2,2-trifluoroethanol, 3-methoxy- 1-propanol, 3-methoxy-1-butanol, 1-methoxy-2-propanol or N,N-dimethylformamide alone or a mixture thereof, and the resulting solution may be added to the emulsions.

Further, there can be used a method wherein the dye and the compound represented by formula (I) of the present invention are dissolved in a volatile organic solvent, the resulting solution is dispersed in water or hydrophilic colloid, and the resulting dispersion is added to the emulsion as described in U.S. Pat. No. 3,469,987; a method wherein a water-insoluble dye and the compound represented by formula (I) are dispersed in a water-soluble solvent without dissolving the dye and the compound, and the resulting dispersion is added to the emulsion as described in JP-B-46-24185; a method wherein the dye and the compound represented by formula (I) are dissolved in an acid, and the resulting solution is added to the emulsion, or an aqueous solution of the dye and the compound represented by formula (I) is prepared in the presence of an acid or a base, and the aqueous solution is added to the emulsion as described in JP-B-44-23389, JP-B-44-27555 and JP-B-57-22091; a method wherein an aqueous solution or a colloid dispersion is prepared in the presence of a surfactant and added to the emulsion as described in U.S. Pat. Nos. 3,822,135 and 4,006,026; a method wherein the dye and the compound represented by (I) are directly dispersed in hydrophilic colloid, and the resulting dispersion is added to the emulsion as described in JP-A-58-105141; and a method wherein the dye and the compound represented by formula (I) are dissolved by using a compound to be red-shifted, and the resulting solution is added to the emulsion as described in JP-A-51-74624.

Furthermore, ultrasonic wave can be used to dissolve the dye and the compound represented by formula (I).

The sensitizing dyes used in the present invention and the compound represented by formula (I) may be added to the emulsions during the preparation of the emulsions at any stage conventionally considered to be advantageous. For example, they may be added during the formation of silver halide grains and/or before desalting, or during desalting and/or before chemical sensitization after desalting as described in U.S. Pat. Nos. 2,735,766, 3,628,960, 4,183,756 and 4,225,666, JP-A-58-184142 and JP-A-60-196749. They may be added immediately before or during chemical ripening or at any stage before coating after chemical ripening as described in JP-A-58-113920. Further, the same compound alone or a combination of compounds having different structures may be divided into two or more portions and added. For example, a part thereof is added during the formation of the grains, and the remainder is added during or after chemical ripening. A part thereof is added before chemical ripening, and the remainder is added after completion of chemical ripening. The types of compounds to be divided or the combinations of compounds may be changed and added.

The amounts of the sensitizing dyes to be added vary depending on the form and size of the silver halide grains, but are preferably used in an amount of from $4\times10^{-8}$ to $8\times10^{-2}$ mol per mol of silver halide.

The compound represented by formula (I) of the present invention may be added before or after the addition of the sensitizing dyes and are used in an amount of preferably from $1\times10^{-6}$ to $5\times10^{-1}$ mol, more preferably from $1\times10^{-5}$ to $2\times10^{-2}$ mol, and most preferably from $1\times10^{-4}$ to $1.6\times10^{-2}$ mol, per mol of silver halide in the silver halide emulsion.

The ratio (by mol) of the sensitizing dye to the compound represented by formula (I) is not particularly limited. However, the ratio of the sensitizing dye/the compound represented by formula (I) is preferably from 100/1 to 1/1000, more preferably from 10/1 to 1/100.

The silver halide used in the present invention may be any of silver chloride, silver bromide, silver iodide, silver chlorobromide, silver chloroiodide, silver chloroiodobromide and silver iodobromide. The silver halide emulsions used in the present invention may contain one kind of silver halide grains or a mixture of two or more kinds of silver halide grains. Silver halide grains may be different in phase between the interior of the grain and the surface layer thereof. The silver halide grains may have a polyphase structure having a joint structure. The silver halide grains may have localized phases on the surface of the grain. The silver halide grains may comprise a uniform phase throughout the entire grain or may be in the mixed form of a uniform phase and other phases.

The silver halide grains used in the present invention may be a monodisperse type or a polydisperse type, and may have a regular crystal form such as a cubic, octahedral or tetradecahedral form, an irregular crystal form or a composite form of these crystal forms. There may be used tabular emulsions comprising grains having such a grain size distribution that AgX grains having an aspect ratio (a ratio of the diameter of the grain in terms of the diameter of the corresponding circle to the thickness of the grain) of 3 or more account for 50% or more of the entire projected areas of the entire grains. An aspect ratio of from 5 to 8 is more preferred. Emulsions may comprise a mixture of grains having various crystal forms. The emulsions may be a surface latent image type wherein a latent image is predominantly formed on the surface of the grain or an internal latent image type wherein a latent image is predominantly formed in the interior of the grain.

The photographic emulsions used in the present invention can be prepared by the methods described in the literature such as P. Glafkides, *Chemie et Physique Photographique* (Paul Montel 1967), G. F. Daffin, *Photographic Emulsion Chemistry* (Focal Press 1966), V. L. Zelikman et al., *Making and Coating Photographic Emulsion* (Focal Press 1964), F. H. Claes et al., *The Journal of Photographic Science,* (21) pages 39 to 50 (1973) and (21) pages 85–92 (1973) and in the patent specifications of JP-B-55-42737, U.S. Pat. Nos. 4,400,463 and 4,801,523, JP-A-62-218959, JP-A-63-213836, JP-A-63- 218938 and JP-A-2-32. Namely, any of the acid process, the neutral process and the ammonia process can be used. A soluble silver salt and a soluble halide can be reacted by the single jet process, the double jet process or a combination thereof. A method wherein grains are formed in the presence of an excess of silver (called a reverse mixing method) can be used. As a type of the double jet process, a method wherein the pAg in a liquid phase in which silver halide is formed is kept constant, that is, the controlled double jet process can also be used. According to this process, a silver halide emulsion wherein the grain form is regular and the grain size is nearly uniform can be obtained.

Further, the present invention can use emulsions prepared by a conversion method including the step of converting silver halide already formed during the course of the formation of silver halide grains and emulsions prepared by a conversion method including the step of converting silver halide grains after completion of the formation of the silver halide grains.

Solvents for silver halide may be used during the preparation of the silver halide grains used in the present invention. Examples of the solvents for silver halide which are often used include thioether compounds (e.g., those described in U.S. Pat. Nos. 3,271,157, 3,574,628, 3,704,130 and 4,276,347), thione compounds and thiourea compounds (e.g., those described in JP-A- 53-144319, JP-A-53-82408, JP-A-55-77737) and amine compounds (e.g., those described in JP-A-54-100717). Further, ammonia can be used in an amount which does not provide any adverse effect.

It is preferred that the addition rates of the silver salt solution (e.g., an aqueous solution of silver nitrate) and the halide solution (e.g., an aqueous solution of sodium chloride) and the amounts and concentrations thereof are increased with time to expedite the growth of the grains during the preparation of the silver halide grains. The methods are described in, for example, British Patent 1,335,925, U.S. Pat. Nos. 3,672,900, 3,650,757 and 4,242,445, JP-A-55-142329, JP-A- 55-158124, JP-A-55-113927, JP-A-58-113928, JP-A-58- 111934 and JP-A-58-111936.

A cadmium salt, a zinc salt, a potassium salt, a rhenium salt, a ruthenium salt, an iridium salt or a complex salt thereof, a rhodium salt or a complex salt thereof, or an iron salt or a complex salt thereof may be-allowed to coexist during the course of the formation of the silver halide grains or during the physical ripening thereof. Particularly, the use of a rhenium salt, an iridium salt, a rhodium salt or an iron salt is preferred.

The amounts of these salts to be added may be arbitrarily determined. However, the iridium salt (e.g., $Na_3IrCl_6$, $Na_2IrCl_6$, $Na_3Ir(CN)_6$) is used in an amount of preferably from $1\times10^{-8}$ to $1\times10^{-5}$ mol per mol of silver. The rhodium salt (e.g., $RhCl_3$, $K_3Rh(CN)_6$) is used in an amount of preferably from $1\times10^{-8}$ mol to $1\times10^{-5}$ mol per mol of silver.

The silver halide emulsions used in the present invention may be used without chemical sensitization. If desired, the silver halide emulsions may be chemical-sensitized.

Examples of chemical sensitization methods include gold sensitization method using gold compounds (described in, for example, U.S. Pat. Nos. 2,448,060 and 3,320,069), sensitization method using metal such as iridium, platinum, rhodium or palladium (described in, for example, U.S. Pat. Nos. 2,448,060, 2,566,246 and 2,566,263), sulfur sensitization method using sulfur-containing compounds (described in, for example, U.S. Pat. No. 2,222,264), selenium sensitization method using selenium compounds and reduction sensitization method using tin salts, thiourea dioxide or polyamides (described in, for example, U.S. Pat. Nos. 2,487,850, 2,518,698 and 2,521,925). These sensitization methods may be used either alone or in a combination of two or more of them.

It is preferred that the silver halide emulsions used in the present invention are subjected to gold sensitization, sulfur sensitization or a combination thereof. Gold sensitizing agents and sulfur sensitizing agents are used in an amount of preferably from $1\times10^{-7}$ to $1\times10^{-2}$ mol, more preferably $5\times10^{-6}$ to $1\times10^{-3}$ mol, per mol of silver. When gold sensitization and sulfur sensitization are carried out in combination, the gold sensitizing agent and the sulfur sensitizing agent are used in a ratio by mol of preferably from 1:3 to 3:1, more preferably from 1:2 to 2:1.

In the present invention, chemical sensitization is carried out at a temperature of from 30° to 90° C. The pH thereof is from 4.5 to 9.0, preferably from 5.0 to 7.0. The time of chemical sensitization varies depending on the temperature, the pH and the types and amounts of the chemical sensitizing agents used, and may be over a period of several minutes to several hours, but is usually from 10 to 200 minutes.

It is preferred in the present invention that the sensitizing dyes are used together with water-soluble iodides such as typically potassium iodide, water-soluble bromides such as typically potassium bromide and water-soluble thiocyanates such as typically potassium thiocyanate to enhance adsorptivity to silver halide or the formation of J-aggregate or to obtain more higher spectral sensitivity. When the silver chloride or silver chlorobromide having a high silver chloride content is used, the effects obtained by using water-soluble bromides or water-soluble thiocyanates are particularly remarkable.

High silver chloride emulsions having a silver chloride content of 50 mol % or more are preferred to conduct ultra-high rapid processing where development time is 30 seconds or less. For this purpose, it is preferred that the concentration of iodide ion including the above-described water-soluble iodides is 0.05 mol % or less because the iodide ion possesses a high development inhibiting effect.

High silver chloride emulsions having a silver chloride content of 80 mol % or more are more preferred to prepare ultra-high rapid processable silver halide photographic materials. When the emulsions are to be prepared, the use of the sensitizing dyes together with the water-soluble bromides and/or the water-soluble thiocyanates is preferred as described above because the formation of J-aggregate can be enhanced and higher spectral sensitivity can be obtained. The amounts of these compounds to be added are preferably from 0.03 to 3 mol %, particularly preferably from 0.08 to 1 mol %, per mol of silver.

High silver chloride grains having a silver chloride content of 80 mol % or more have such a characteristic that when the grains are spectral-sensitized to infrared region, high sensitivity can be obtained, and a latent image having excellent stability can be obtained. High silver chloride grains having localized phases described in JP-A-2-248945 are more preferred. It is preferred that the localized phases have a silver bromide content of 15 mol % or more as described in the above patent specification. A silver bromide content of from 20 to 60 mol % is more preferred. It is most preferred that the silver bromide content is from 30 to 50 mol %, and the remainder is silver chloride. The localized phases may exist on the surface of the grain or in the interior thereof, or may be distributed so that a portion of the localized phases exists in the interior of the grain, a portion thereof exists on the surface thereof, and a portion thereof exists in the subsurface thereof. The localized phases may exist in a laminar structure so that the silver halide grain is surrounded with the localized phases in the interior of the grain or on the surface thereof. The localized phases may exist in a discontinuous independent form. In a preferred embodiment of the arrangement of the localized phase having a higher silver bromide content than that of the circumference, the localized phase having a silver bromide content of more than 15 mol % is formed on the surface of the silver halide grain by epitaxial growth.

The silver bromide content of the localized phase can be analyzed by X-ray diffractometry (e.g., described in *New Experimental Chemical Lecture* 6, "Structural Analysis", edited by Chemical Society of Japan, published by Maruzen, Japan) or XPS method (e.g., *Surface Analysis, IPA, Application of Auger Electron Photoelectron Spectroscopy,* published by Kodan-sha, Japan). The localized phases are preferably from 0.1 to 20%, more preferably 0.5 to 7%, of silver based on the total amount of silver in the silver halide grain.

The interface between the localized phase having a high silver bromide content and other phase may be a clear phase boundary or may have a short transition zone where the halogen composition is gradually changed.

The localized phase having a high silver bromide content can be formed by various methods. For example, the localized phases can be formed by reacting a soluble silver salt with a soluble halide according to the single jet process or the double jet process or by a conversion method including a stage where an already formed silver halide is converted to silver halide having a smaller solubility product. Alternatively, the localized phases can be formed by adding fine silver bromide grains to silver halide grains to recrystallize the fine silver bromide grains on the surfaces of the silver halide grains.

The silver halide emulsions prepared according to the present invention can be applied to any of color photographic materials and black and white photographic materials.

Examples of the color photographic materials include color paper, color films for photographing and reversal color films. Examples of the black and white photographic materials include X-ray films, general-purpose films for photographing and films for printing photographic materials.

Additives described in *Research Disclosure* vol. 176, No. 17643 (RD 17643) and *ibid.* vol. 187, No. 18716 (RD 18716) can be applied to the emulsions of the photographic materials used in the present invention without particular limitation.

Places where additives are described in RD 17643 and RD 18716 are listed in Table 1 below.

TABLE 1

| Additive | RD 17643 | RD 18716 |
|---|---|---|
| 1 Chemical Sensitizing Agent | page 23 | right column of page 648 |
| 2 Sensitivity Increaser | — | " |
| 3 Spectral Sensitizing Agent, Supersensitizing Agent | pages 23–24 | right column of page 648 to right column of page 649 |
| 4 Brightener | page 24 | |
| 5 Anti-fogging Agent, Stabilizer | pages 24–25 | right column of page 649 |
| 6 Light Absorber, Filter Dye, UV Absorber | pages 25–26 | right column of page 649 to left column of page 650 |
| 7 Anti-staining Agent | right column of page 25 | left column to right column of page 650 |
| 8 Dye Image Stabilizer | page 25 | |
| 9 Hardening Agent | page 26 | left column of page 651 |
| 10 Binder | page 26 | " |
| 11 Plasticizer, Lubricant | page 27 | right column of page 650 |
| 12 Coating Aid, Surfactant | pages 26–27 | right column of page 650 |
| 13 Antistatic Agent | page 27 | " |

Dyes other than sensitizing dye suitable for use in the photographic material of the present invention will be described in detail below.

The photographic material of the present invention may contain colloidal silver and other dyes for the purpose of anti-irradiation and anti-halation, and especially for separation of the spectral sensitivity distribution of each light-sensitive layer and for ensuring safety to a safelight.

Such dyes include, for example, oxonole dyes having pyrazolone nuclei, barbituric nuclei or barbituric acid nuclei, such as those described in U.S. Pat. Nos. 506,385, 1,177,429, 1,131,884, 1,338,799, 1,385,371, 1,467,214, 1,438,102 and 1,553,516, JP-A-48- 85130, JP-A-49-114420, JP-A-52-117123, JP-A-55-161233, JP-A-59-111640, JP-B-39-22069, JP-B-43-13168, JP-B-62- 273527, and U.S. Pat. Nos. 3,247,127, 3,469,985 and 4,078,933; other oxonole dyes, such as those described in U.S. Pat. Nos. 2,533,472 and 3,379,533, British Patent 1,278,621, JP-A-1-134447, and JP-A-1-183652; azo dyes such as those described in British Patents 575,691, 680,631, 599,623, 786,907, 907,125 and 1,045,609, U.S. Pat. No. 4,255,326, and JP-A-59-211043; azomethine dyes such as those described in JP-A-50-100116, JP-A-54-118247 and British Patents 2,014,598 and 750,031; anthraquinone dyes such as those described in U.S. Pat. No. 2,865,752; arylidene dyes such as those described in U.S. Pat. Nos. 2,538,009, 2,688,541 and 2,538,008, British Patents 584,609 and 1,210,252, JP-A-50-40625, JP-A-51-3623, JP-A-51-10927, JP-A-54-118247, JP-B-48-3286 and JP-B-59-37303; styryl dyes such as those described in JP-B-28-3082, JP-B-44-16594, and JP-B-59- 28898; triarylmethane dyes such as those described in British Patents 446,538, and 1,335,422, and JP-A-59- 228250; merocyanine dyes such as those described in British Patents 1,075,653, 1,153,341, 1,284,730, 1,475,228 and 1,542,807; and cyanine dyes such as those described in U.S. Pat. Nos. 2,843,486 and 3,294,539, and JP-A-1-291247.

For the purpose of preventing diffusion of these dyes in the photographic material of the present invention, various means may be employed. For instance, a ballast group may be introduced into the dyes so as to make them non-diffusive.

A hydrophilic polymer charged oppositely to the dissociated anion dye may be incorporated into a layer along with the dye as a mordant, whereby the dye is localized and fixed in the particular layer due to the interaction of the polymer and the dye molecule, as described in U.S. Pat. Nos. 2,548,564, 4,124,386 and 3,625,694.

A water-insoluble solid dye may be used for coloring a particular layer, as so described in JP-A-56- 12639, JP-A-55-155350, JP-A-55-155351, JP-A-63-278838, JP-A-63-197943, and European Patent 15,601.

Fine grains of a metal salt to which dyes have been adsorbed may be used for coloring a particular layer, as described in U.S. Pat. No. 2,719,088, 2,496,841 and 2,496,842, and JP-A-60-45237.

The photographic material of the present invention may contain an antifoggant or stabilizer selected from, for example, azoles (e.g., benzothiazolium salts, nitroimidazoles, nitrobenzimidazoles, chlorobenzimidazoles, bromobenzimidazoles, nitroindazoles, benzotriazoles, aminotriazoles); mercapto compounds (e.g., mercaptothiazoles, mercaptobenzothiazoles, mercaptobenzimidazoles, mercaptothiadiazoles, mercaptotetrazoles (especially 1-phenyl-5-mercaptotetrazole), mercaptopyrimidines, mercaptotriazines); thioketo compounds (e.g., oxazolinethiones); azaindenes (e.g., triazaindenes, tetrazaindenes (especially 4-hydroxy-substituted (1,3,3a,7)tetrazaindenes), pentazaindenes); benzenethiosulfonic acids; benzenesulfinic acids; and benzenesulfonic acid amides.

The photographic material of the present invention may contain color couplers, preferably non-diffusive couplers having a hydrophobic group called a ballast group in the molecule or polymerized couplers. The couplers may be either 4-equivalent or 2-equivalent with respect to silver ions. The photographic material of the present invention may also contain colored couplers having a color-correcting effect, or couplers capable of releasing a development inhibitor during development of the photographic material (so-called DIR couplers). The photographic material may also contain colorless DIR coupling compounds capable of producing a colorless product by a coupling reaction and releasing a development inhibitor.

Preferred examples of such couplers for use in the present invention are described in JP-A-62-215272, from page 91, right top column, line 4 to page 121, left top column, line 6; and JP-A-2-33144, from page 3, right top column, line 14 to page 18, left top column, last line, and from page 30, right top column, line 6 to page 35, right bottom column, line 11.

Specifically, suitable magenta couplers include 5-pyrazolone couplers, pyrazolobenzimidazole couplers, pyrazolotriazole couplers, pyrazolotetrazole couplers, cyanoacetylchroman couplers, and open-chain acylacetonitrile couplers; suitable yellow couplers include acylacetamide couplers (e.g., benzoylacetanilides, pivaloylacetanilides); and suitable cyan couplers include naphthol couplers and phenol couplers. Preferred cyan couplers include phenol couplers having an ethyl group at the meta-position of the phenol nucleus, 2,5-diacylamino-substitued phenol couplers, phenol couplers having a phenylureido group at the 2-position and having an acylamino group at the 5-position, and naphthol couplers having a sulfonamido or amido group at the 5-position of the naphthol nucleus, such as those described in U.S. Pat. Nos. 3,772,002, 2,772,162, 3,758,308, 4,126,396, 4,334,011, 4,327,173, 3,446,622, 4,333,999, 4,451,559 and 4,427,767, as they form fast images.

Two or more different kinds of the above-mentioned couplers may be incorporated into one and the same layer, or one and the same compound of the couplers may be added to two or more layers, for the purpose of satisfying the intended characteristics of the photographic material of the present invention.

The photographic material of the present invention may contain an anti-fading agent selected from, for example, hindered phenols such as hydroquinones, 6-hydroxychromans, 5-hydroxycoumarans, spirochromans, p-alkoxyphenols and bisphenols; and gallic acid derivatives, methylenedioxybenzenes, aminophenols, hindered amines and ether or ester derivatives of them formed by silylating or alkylating the phenolic hydroxyl group of the compounds. In addition, metal complexes such as bis(salicyl-aldoximato)nickel complexes and bis(N,N-dialkyldithio-carbamato)nickel complexes may also be used as an anti-fading agent.

For photographic processing of the photographic material of the present invention, any known method and any known processing solution may be employed. The processing temperature may be selected generally from the range between 18° C. and 50° C. However, it may be lower than 18° C. or higher than 50° C. In accordance with the object of the photographic material, either black-and-white development for forming a silver image or color development for forming a color image may be employed.

As a black-and-white developer for the former black-and-white development, any known developing agent, such as dihydroxybenzenes (e.g., hydroquinone), 3-pyrazolidones (e.g., 1-phenyl-3-pyrazolidone) and aminophenols (e.g., N-methyl-p-aminophenol) may be employed singly or in combinations of them.

The color developer for the latter color development is generally an alkaline aqueous solution containing a color developing agent. The color developing agent in it may be a known primary aromatic amine developing agent, such as phenylenediamines (e.g., 4-amino-N,N-diethylaniline, 3-methyl-4-amino-N,N-diethylaniline, 4-amino-N-ethyl-N-β-hydroxyethylaniline, 3-methyl- 4-amino-N-ethyl-N-β-hydroxyethylaniline, 3-methyl- 4-amino-N-ethyl-N-β-methanesulfonamidoethylaniline, 4-amino-3-methyl-N-ethyl-N-β-methoxyethylaniline).

In addition, the color developing agents described in F. A. Meson, *Photographic Processing Chemistry* (published by Focal Press Co., 1966), pp. 226–229 and in U.S. Pat. Nos. 2,193,015 and 2,592,364, and JP-A- 48-64933 may also be used.

The developer may additionally contain a pH buffer such as alkali metal sulfites, carbonates, borates or phosphates, as well as a development inhibitor or anti-foggant such as bromides, iodides or organic antifoggants. If desired, it may also contain a water softener; a preservative such as hydroxylamine; an organic solvent such as benzyl alcohol or diethylene glycol; a development accelerator such as polyethylene glycol, quaternary ammonium salts or amines; a dye forming coupler; a competing coupler; a foggant such as sodium boronhydride; a developing aid such as 1-phenyl-3-pyrazolidone; a thickener; a polycarboxylic acid chelating agent such as those described in U.S. Pat. No. 4,083,723; and an antioxidant such as those described in German Patent OLS No. 2,622,950.

After being color-developed, the color photographic material is generally bleached. Bleaching of the material may be carried out simultaneously with or separately from fixation. Suitable bleaching agents to be used for bleaching the material include, for example, compounds of polyvalent metals such as iron(III), cobalt(III), chromium(VI) and copper(II), as well as peracids, quinones and nitroso compounds. Specific examples of suitable bleaching agents include ferricyanides; bichromates; organic complexes of iron(III) or cobalt(III), such as complexes with aminopolycarboxylic acids (e.g., ethylenediaminetetraacetic acid, nitrilotriacetic acid, 1,3-diamino-2-propanol-tetraacetic acid) or with organic acids (e.g., citric acid, tartaric acid, malic acid); persulfates; permanganates; and nitrosophenols. Of them, especially advantageous are potassium ferricyanide, sodium ethylenediaminetetraacetato/iron(III) and ammonium ethylenediaminetetraacetato/iron(III). Ethylenediaminetetraacetato/iron(III) complexes are useful both in an independent bleaching solution and in a one-bath bleach-fixing solution.

The bleaching solution or bleach-fixing solution to be used for processing the photographic material of the present invention may contain various additives, for example, a bleaching accelerator such as those described in U.S. Pat. Nos. 3,042,520 and 3,241,966, JP-B-45-8506, and JP-B-45-8836; and a thiol compound such as those described in JP-A-53-65732. After being bleached or bleach-fixed, the photographic material may be rinsed in water or may be directly stabilized in a stabilizing bath without rinsing in water.

The support of the photographic material of the present invention may be any ordinary transparent film support such as a cellulose nitrate film or polyethylene terephthalate film support, or a reflective support, which is used in forming ordinary photographic materials.

The "reflective support" of the photographic material of the present invention is one which elevates the reflectivity of the support itself to make the color image formed in the silver halide emulsion layer clear and sharp. Reflective supports of this kind include a support coated with a hydrophobic resin containing a dispersion of a photo-reflective substance, such as titanium oxide, zinc oxide, calcium carbonate or calcium sulfate, so as to elevate the reflectivity of the support to light within the visible ray wavelength range, and a support made of a hydrophobic resin containing a dispersion of such a photo-reflective substance. Examples of suitable reflective supports include a baryta paper, a polyethylene-coated paper, a polypropylene synthetic paper, and a transparent support coated with a reflective layer thereon or containing a reflective substance therein. Suitable transparent supports include, for example, a glass sheet, a polyester film such as polyethylene terephthalate, cellulose triacetate or cellulose nitrate film, as well as a polyamide film, a polycarbonate film, a polystyrene film, and a polyvinyl chloride resin film. These supports are suitably selected in accordance with the use and object of the photographic material.

Exposure of the photographic material of the present invention for forming a photographic image thereon may be effected by any ordinary means. For instance, any one of various known light sources, such as natural light (sunlight), a tungsten lamp, a fluorescent lamp, a mercury lamp, a xenon-arc lamp, a carbon-arc lamp, a xenon-flash lamp, lasers, an LED and a CRT can be used for exposure. The exposing time may be any ordinary one for ordinary cameras of from 1/1000 second to one second. As the case may be, shorter exposures of less than 1/1000 second, for example from $1/10^6$ to $1/10^4$ second, may be applied to the photographic material of the present invention by the use of a xenon-flash lamp; or longer exposures of more than one second may be applied thereto. If desired, a color filter may be used for exposure of the photographic material of the present invention for adjusting the spectral composition of the light to be applied thereto. Laser rays may be used for exposure of the material. If desired, the material may also be exposed with a light to be emitted from phosphors as excited with electron rays, X rays, γ rays or α rays.

The present invention will be described in more detail by way of the following examples, but it should be understood that the present invention is not to be deemed to be limited thereto.

EXAMPLE 1

To a reaction vessel were added 1,000 ml of water, 25 g of deionized bone gelatin, 15 ml of a 50% aqueous solution of $NH_4NO_3$, and 7.5 ml of a 25% aqueous solution of $NH_3$, and kept at 50° C. with well stirring. Then, 750 ml of a 1N aqueous solution of silver nitrate and a 1N aqueous solution of potassium bromide were added thereto over a period of 50 minutes. The silver potential during reaction was kept at +60 mV to a saturated calomel electrode. The 1N aqueous solution of potassium bromide was added in an amount necessary for keeping the silver potential at +60 mV.

The silver bromide grains thus obtained were cubic with a side length of 0.74±0.06 μm. After the temperature of the above-described emulsion was lowered, a copolymer of isobutene with monosodium maleate was added thereto as a coagulant, and desalting was conducted by sedimentation washing. Then, 95 g of deionized bone gelatin and 430 ml of water were added to the emulsion to adjust it to a pH of 6.5 and a pAg of 8.3 at 50° C. Sodium thiosulfate was then added thereto at 40° C., and the emulsion was ripened at 60° C. for a period of 45 minutes to give the optimum sensitivity. This emulsion contained 0.74 mole of silver bromide per kg of emulsion.

The emulsion was divided, and a sensitizing dye was added to the respective divided emulsions at 40° C. as shown in Table 2. After the respective emulsions were stirred for 30 minutes for ripening, the hydrazone compounds according to the present invention or the compounds for comparison as shown in Table 2 were added thereto in amounts described in Table 2 at 40° C. In Table 2, the sensitizing dyes and the hydrazone compounds were used in concentrations of $10^{-4}$ mol/mol Ag and $10^{-3}$ mol/mol Ag, respectively.

Subsequently, 0.01 g of 4-hydroxy-6-methyl- 1,3,3a,7-tetrazaindene, 15 g of a 10% gel of deionized gelatin, and 55 ml of water per 50 g of emulsion were added thereto, and a cellulose triacetate film base was coated with the resulting emulsion in the following manner. The quantity of the emulsion coated was adjusted to give a silver amount of 2.2 g/m$^2$ and a gelatin amount of 3.3 g/m$^2$. As an upper layer, an aqueous solution mainly comprising 0.22 g/liter of sodium dodecylbenzenesulfonate, 0.50 g/liter of homopolymer of sodium p-sulfostyrene, 3.9 g/liter of 1,3-bis(vinylsulfonyl)-2-propanol and 50 g/liter of gelatin was simultaneously applied so as to give a gelatin amount of 0.9 g/m$^2$.

For the coated samples prepared, fluctuation widths of photographic sensitivity with changes in exposure temperature and with natural storage were tested in the following manner.

To evaluate the fluctuation widths of photographic sensitivity with exposure temperature, the coated samples were kept at a temperature of 15° C. at a humidity of 55%, and at a temperature of 35° C. at a humidity of 55%, and exposed to light of a tungsten lamp (2856K°) for one second through an orange color filter SC54 manufactured by Fuji Photo Film Co., Ltd. (which transmits the light of longer wavelengths than 520 nm) and an optical continuous wedge. The samples exposed were developed with a developer which was prepared by three times diluting a D-72 developer in concentration and then adjusted to pH 10.4, and thereafter stopped, fixed, washed with water and dried.

The density of the treated samples thus prepared was determined with a densitometer manufactured by Fuji Photo Film Co., Ltd. to obtain orange filter sensitivity ($S_o$) and fog. The reference of optical density to determine sensitivity was taken as "fog +0.2", and the reciprocal of an exposure amount required to give the density was defined as the sensitivity. For evaluating the fluctuation widths of the orange color filter sensitivity ($\Delta S_o$) with changes in exposure temperature, the sensitivity of the respective samples exposed at 15° C.-55% was taken as 100, and changes in sensitivity of the corresponding samples exposed at 35° C.-55% were determined as relative values. The results are shown in Table 2.

TABLE 2

| Sample No. | Sensitizing Dyes: Compound No. | Sensitizing Dyes: Amount | Hydrazones: Compound No. | Hydrazones: Amount | Relative Sensitivity $\Delta S_o$ | Remarks |
|---|---|---|---|---|---|---|
| 1-1 | X-7 | 3.1 | — | — | 148 | |
| 1-2 | X-7 | 3.1 | H-1 | 3.0 | 148 | C |
| 1-3 | X-7 | 3.1 | H-1 | 10.0 | 151 | C |
| 1-4 | X-7 | 3.1 | H-2 | 3.0 | 145 | C |
| 1-5 | X-7 | 3.1 | H-2 | 10.0 | 141 | C |
| 1-6 | X-7 | 3.1 | I-1 | 3.0 | 129 | I |
| 1-7 | X-7 | 3.1 | I-1 | 10.0 | 126 | I |
| 1-8 | X-7 | 3.1 | I-4 | 3.0 | 126 | I |
| 1-9 | X-7 | 3.1 | I-4 | 10.0 | 126 | I |

TABLE 2-continued

| Sample No. | Sensitizing Dyes: Compound No. | Sensitizing Dyes: Amount | Hydrazones: Compound No. | Hydrazones: Amount | Relative Sensitivity $\Delta S_o$ | Remarks |
|---|---|---|---|---|---|---|
| 1-10 | X-7 | 3.1 | I-15 | 3.0 | 135 | I |
| 1-11 | X-7 | 3.1 | I-15 | 10.0 | 135 | I |
| 1-12 | X-7 | 3.1 | II-1 | 3.0 | 111 | I |
| 1-13 | X-7 | 3.1 | II-1 | 10.0 | 107 | I |
| 1-14 | X-7 | 3.1 | II-5 | 3.0 | 107 | I |
| 1-15 | X-7 | 3.1 | II-5 | 10.0 | 107 | I |
| 1-16 | X-7 | 3.1 | II-7 | 3.0 | 107 | I |
| 1-17 | X-7 | 3.1 | II-7 | 10.0 | 102 | I |
| 1-18 | X-7 | 3.1 | II-22 | 3.0 | 102 | I |
| 1-19 | X-7 | 3.1 | II-22 | 10.0 | 101 | I |
| 1-20 | X-7 | 3.1 | II-29 | 3.0 | 117 | I |
| 1-21 | X-7 | 3.1 | II-29 | 10.0 | 115 | I |
| 1-22 | X-7 | 3.1 | II-31 | 3.0 | 126 | I |
| 1-23 | X-7 | 3.1 | II-31 | 10.0 | 120 | I |
| 1-24 | X-12 | 3.1 | — | — | 115 | |
| 1-25 | X-12 | 3.1 | II-1 | 3.0 | 105 | I |
| 1-26 | X-12 | 3.1 | II-1 | 10.0 | 102 | I |
| 1-27 | X-12 | 3.1 | II-7 | 3.0 | 104 | I |
| 1-28 | X-12 | 3.1 | II-7 | 10.0 | 101 | I |
| 1-29 | X-5 | 3.1 | — | — | 135 | |
| 1-30 | X-5 | 3.1 | II-5 | 3.0 | 115 | I |
| 1-31 | X-5 | 3.1 | II-5 | 10.0 | 110 | I |
| 1-32 | X-5 | 3.1 | II-11 | 3.0 | 107 | I |
| 1-33 | X-5 | 3.1 | II-11 | 10.0 | 104 | I |

C: Comparison, I: Invention (H-1)

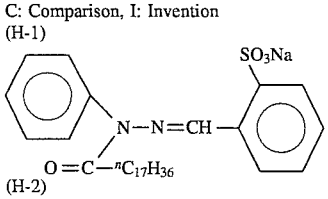

(H-2)

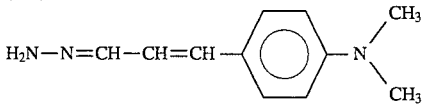

As is apparent from Table 2, the combinations of the present invention can significantly depress increases in photographic sensitivity, even if the temperature is raised on exposure.

EXAMPLE 2

Coated samples were prepared in the same manner as in Example 1, except that cubic grains with somewhat rounded corners prepared in the same manner as in Example 1 with the exception that the silver potential during reaction was kept at +40 mV were used in the preparation of the silver bromide emulsion, and that the sensitizing dyes and the hydrazone compounds according to the present invention were changed to ones as shown in Table 3. The concentrations of the sensitizing dyes and the hydrazone compounds were also the same as those in Example 1.

For the samples prepared, the fluctuation widths of the photographic sensitivity with changes in exposure temperature were evaluated in the same manner as in Example 1. The results are shown in Table 3.

Furthermore, in order to evaluate the fluctuation widths of the photographic sensitivity with natural storage, the coated samples were stored in a room in the natural state for a period of 6 months, and then kept at 15° C.-55% prior to exposure, similarly exposed and developed.

The fluctuation widths of the photographic sensitivity (orange color filter sensitivity) with natural storage were indicated by relative sensitivity obtained when the sensitivity obtained for the corresponding samples sealed in argon gas and stored in a refrigerator at −30° C. for the same period was taken as 100. The results are shown in Table 3.

Table 3 shows that the combinations in the present invention significantly reduces fluctuations of the sensitivity with changes in temperature on exposure and further a reduction in sensitivity during natural storage. It will also be understood from these results that such effect can be obtained only by the combinations with the specified sensitizing dyes.

TABLE 3

| | Sensitizing Dyes | | Hydrazones | | Relative | Relative | |
|---|---|---|---|---|---|---|---|
| Sample No. | Compound No. | Amount | Compound No. | Amount | Sensitivity (35° C.) $\Delta S_0$ | Sensitivity (Time Elapse) $\Delta S_0$ | Remarks |
| 2-1 | S-1 | 3.8 | — | — | 170 | 93 | |
| 2-2 | S-1 | 3.8 | H-3 | 3.0 | 138 | 87 | Comparison |
| 2-3 | S-1 | 3.8 | H-3 | 15.0 | 132 | 85 | Comparison |
| 2-4 | S-1 | 3.8 | II-1 | 3.0 | 141 | 93 | Comparison |
| 2-5 | S-1 | 3.8 | II-1 | 15.0 | 135 | 85 | Comparison |
| 2-6 | S-2 | 4.1 | — | — | 162 | 89 | |
| 2-7 | S-2 | 4.1 | H-3 | 15.0 | 155 | 87 | Comparison |
| 2-8 | S-2 | 4.1 | II-1 | 15.0 | 151 | 89 | Comparison |
| 2-9 | S-3 | 3.1 | — | — | 105 | 95 | |
| 2-10 | S-3 | 3.1 | H-3 | 15.0 | 110 | 89 | Comparison |
| 2-11 | S-3 | 3.1 | II-1 | 15.0 | 105 | 93 | Comparison |
| 2-12 | X-24 | 2.8 | — | — | 107 | 62 | |
| 2-13 | X-24 | 2.8 | H-3 | 15.0 | 112 | 68 | Comparison |
| 2-14 | X-24 | 2.8 | I-16 | 15.0 | 105 | 78 | Invention |
| 2-15 | X-24 | 2.8 | II-27 | 3.0 | 104 | 81 | Invention |
| 2-16 | X-24 | 2.8 | II-27 | 15.0 | 102 | 93 | Invention |
| 2-17 | X-24 | 2.8 | II-11 | 3.0 | 102 | 85 | Invention |
| 2-18 | X-24 | 2.8 | II-11 | 15.0 | 101 | 95 | Invention |
| 2-19 | X-24 | 2.8 | II-22 | 3.0 | 100 | 89 | Invention |
| 2-20 | X-24 | 2.8 | II-22 | 15.0 | 100 | 97 | Invention |
| 2-21 | X-50 | 0.2 | — | — | 162 | 66 | |
| 2-22 | X-50 | 0.2 | H-3 | 3.0 | 151 | 66 | Comparison |
| 2-23 | X-50 | 0.2 | H-3 | 15.0 | 148 | 72 | Comparison |
| 2-24 | X-50 | 0.2 | I-20 | 15.0 | 132 | 81 | Invention |
| 2-25 | X-50 | 0.2 | II-22 | 3.0 | 115 | 85 | Invention |
| 2-26 | X-50 | 0.2 | II-22 | 15.0 | 110 | 93 | Invention |
| 2-27 | X-51 | 1.0 | — | — | 81 | 83 | |
| 2-28 | X-51 | 1.0 | H-3 | 3.0 | 81 | 83 | Comparison |
| 2-29 | X-51 | 1.0 | H-3 | 15.0 | 83 | 78 | Comparison |
| 2-30 | X-51 | 1.0 | II-7 | 3.0 | 87 | 93 | Invention |
| 2-31 | X-51 | 1.0 | II-7 | 15.0 | 93 | 98 | Invention |
| 2-32 | X-51 | 1.0 | II-22 | 3.0 | 93 | 95 | Invention |
| 2-33 | X-51 | 1.0 | II-22 | 15.0 | 95 | 98 | Invention |

(H-3)

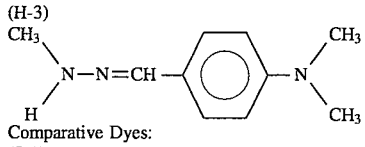

Comparative Dyes:

(S-1)

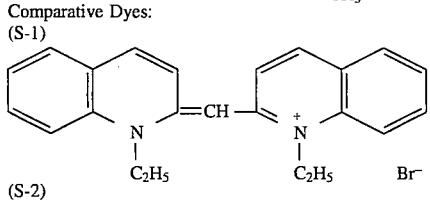

(S-2)

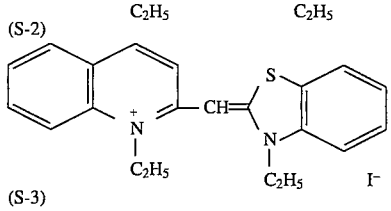

(S-3)

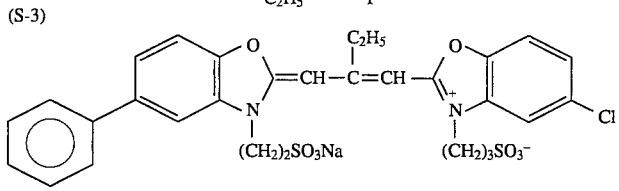

EXAMPLE 3

To 1 liter of a 2% aqueous solution of gelatin were added 6.5 g of potassium bromide, 1.2 g of potassium iodide and 4.9 g of potassium thiocyanate. Then, 0.4 liter of an aqueous solution containing 57.5 g of potassium bromide and 2.5 g of potassium iodide, and 0.4 liter of an aqueous solution containing 85 g of silver nitrate were added thereto by the double-jet method at the same flow rate over a period of 45 minutes with stirring at 70° C. The mixture was then cooled to 65° C., and each of the sensitizing dyes according to the present invention shown in Table 5 was added thereto as a methanol solution. Then, stirring was conducted for 15 minutes. Subsequently, a copolymer of isobutene with monosodium maleate was added thereto to give a pH of 3.8. After sedimentation washing, gelatin, water and phenol were added thereto to adjust the emulsion to a pH of 6.8 and a pAg of 8.7. The silver halide grains thus obtained were 1.46 μm in mean size and 0.17 μm in mean thickness (mean diameter/thickness: 8.59). Each of the sensitizing dyes shown in Table 4 was then added to this emulsion at 40° C. After 10 minutes, sodium thiosulfate pentahydrate, potassium tetraaurate and potassium thiocyanate were further added thereto, and the temperature was raised to 60° C. for ripening to obtain the optimum sensitivity. Each of the hydrazone compounds according to the present invention or the compounds for comparison shown in Table 4 was added at 40° C. to the silver iodobromide emulsion thus obtained. Then, a 14% gel of deionized gelatin, water, a benztriazole derivative and $2\times10^{-3}$ mole of 4-hydroxy-6-methyl- 1,3,3a,7-tetrazaindene per mole of silver iodobromide were added, and further, a coupler emulsified dispersion which was prepared by emulsifying the following cyan couplers (C-1, C-2 and C-3) dissolved in ethyl acetate, tricresyl phosphate and di-m-butylphthalate into a 10% aqueous solution of gelatin containing dodecylbenzenesulfonic acid was added thereto. After stirring and mixing, the following compositions were coated in multiple layers on a polyethylene terephthalate film base which had been subjected to antistatic treatment, thus obtaining each sample. The concentrations of the sensitizing dyes and the hydrazone compounds in the table were the same as those in Example 1.

Numerals of the respective components indicate coated amounts in g/m$^2$ unit. For the silver halide, numerals indicate coated amounts converted to silver.

| | |
|---|---|
| First Layer (Antihalation Layer): | |
| Black Colloidal Silver | silver 0.18 |
| Gelatin | 1.40 |
| Second Layer (Sensitive Emulsion Layer): | |
| Silver Iodobromide Emulsion | silver 2.80 |
| Sensitizing Dye | See Table 4 |
| Hydrazone Compound | See Table 4 |
| C-1 | 0.490 |
| C-2 | 0.110 |
| C-3 | 0.125 |
| Tricresyl Phosphate | 0.33 |
| Di-m-butylphthalate | 0.15 |
| U-1 | 0.175 |
| U-2 | 0.125 |
| U-3 | 0.175 |
| Gelatin | 2.85 |
| Third Layer (First Protective Layer): | |
| Gelatin | 1.06 |
| Fourth Layer (The Second Protecting Layer): | |
| Silver Iodobromide Emulsion | silver 0.30 |

-continued

| | |
|---|---|
| (silver iodide: 1 mole %, mean grain size: 0.07 μm) | |
| U-4 | 0.11 |
| U-5 | 0.17 |
| HA-1 | 0.60 |
| Gelatin | 1.00 |

Further, in order to improve keeping quality, treating property, pressure resistance, antifungal and antimicrobial properties, antistatic property and coating property, all layers contained W-1, W-2, W-3, BP-1, BP-2, 5-methylthio-2-mercapto-1,3,4-thiazole, 1-p-carboxyphenyl- 5-mercaptotetrazole, 1-m-sulfophenyl-5-mercaptotetrazole, 5-nitro-1H-indazole, 6-(2-ethylhexanoylamino)-2-mercaptobenzimidazole, 1-m-(3-methylureido)phenyl-5-mercaptotetrazole, α-lipoic acid, 2-hydroxyamino- 4,5-bis(hexylamino)-1,3,3a,7-tetrazaindene, sodium p-toluenesulfinate, an iron salt, a lead salt, a gold salt, a platinum salt, an iridium salt and a rhodium salt.

The formulae of the compounds described above are as follows:

C-1

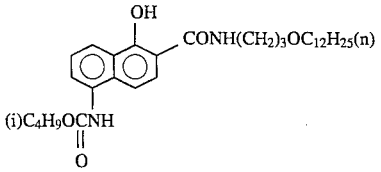

C-2

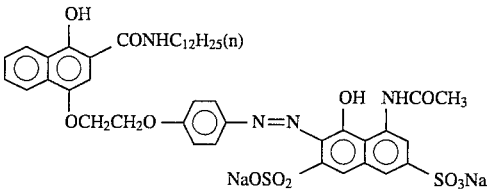

C-3

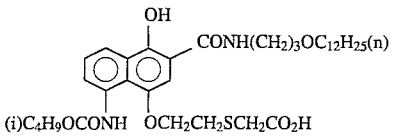

U-1

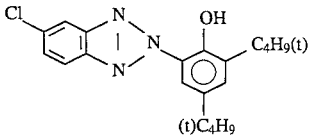

U-2

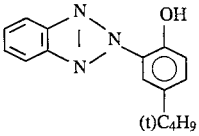

-continued

U-3

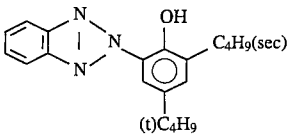

U-4

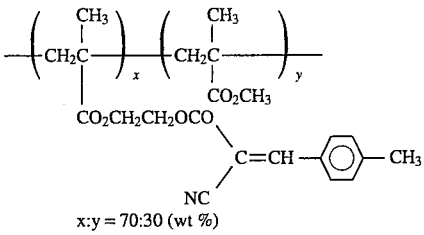

x:y = 70:30 (wt %)

U-5

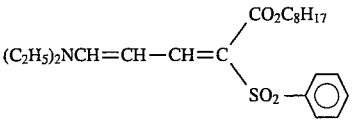

HA-1

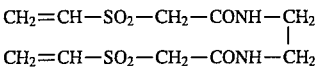

W-1

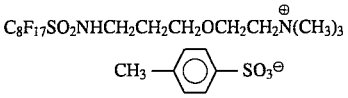

W-2

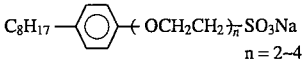

n = 2~4

W-3

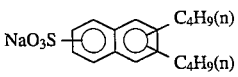

BP-1

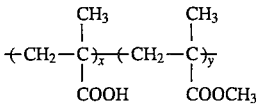

x/y = 10/90

BP-2

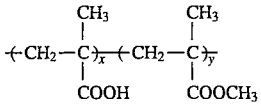

x/y = 40/60

For the coated samples thus prepared, the fluctuation widths of the photographic sensitivity with time after exposure (latent image increase-decrease sensitivity) and with storage under an oxygen partial pressure of 10 atm were evaluated as follows.

For the purpose of evaluating the fluctuation widths of the photographic sensitivity with time after exposure, the samples were exposed for 1/100 sec through an optical wedge and an orange color filter in the same manner as in Example 1. The samples exposed were stored at 50° C. at a relative humidity of 30% for 5 days, followed by development using the following developing stages and developer. In order to evaluate the fluctuation widths of the photographic sensitivity with storage under an oxygen partial pressure of 10 atm, the samples were stored at 25° C. under an oxygen partial pressure of 10 atm for 4 days, followed by exposure and color development in the same manner as described above.

The transmission density of the samples thus treated was determined through a red filter to obtain characteristic curves. The reciprocals of the exposure amounts required to give the "fog +0.2" was defined as the sensitivity (orange color filter sensitivity $S_0$).

The fluctuation widths of the photographic sensitivity with time after exposure were evaluated as relative values obtained when the corresponding samples which were developed immediately after exposure was taken as 100. The results are shown in Table 4.

The fluctuation widths of the photographic sensitivity with storage under an oxygen partial pressure of 10 atm were evaluated as relative values obtained when the sensitivity of the corresponding samples which were sealed in argon gas and stored in a refrigerator at −30° C. was taken as 100. The results are also shown in Table 4.

| Development Method | | | | |
|---|---|---|---|---|
| Stage | Processing Time | Processing Temperature | Replenisher | Tank Capacity |
| Color Development | 2 min 45 sec | 38° C. | 33 ml | 20 liters |
| Bleaching | 6 min 30 sec | 38° C. | 25 ml | 40 liters |
| Rinsing | 2 min 10 sec | 24° C. | 1200 ml | 20 liters |
| Fixing | 4 min 20 sec | 38° C. | 25 ml | 30 liters |
| Rinsing (1) | 1 min 05 sec | 24° C. | counter-current system of from (2) to (1) | 10 liters |
| Rinsing (2) | 1 min 00 sec | 24° C. | 1200 ml | 10 liters |
| Stabilization | 1 min 05 sec | 38° C. | 25 ml | 10 liters |
| Drying | 4 min 20 sec | 55° C. | | |

Replenisher being per 1 m long by 35 mm wide

The processing solutions had the following compositions.

| | Mother Solution (g) | Replenisher (g) |
|---|---|---|
| Color developing Solution | | |
| Diethylenetriamine-pentaacetic Acid | 1.0 | 1.1 |
| 1-Hydroxyethylidene-1,1-diphosphonic Acid | 3.0 | 3.2 |
| Sodium Sulfite | 4.0 | 4.4 |
| Potassium Carbonate | 30.0 | 37.0 |
| Potassium Bromide | 1.4 | 0.7 |
| Potassium Iodide | 1.5 mg | — |
| Hydroxylamine Sulfate | 2.4 | 2.8 |
| 4-[N-Ethyl-N-β-hydroxyethylamino]-2-methylaniline Sulfate | 4.5 | 5.5 |

-continued

| | Mother Solution (g) | Replenisher (g) |
|---|---|---|
| Add Water to make | 1.0 liter | 1.0 liter |
| pH | 10.05 | 10.10 |
| Bleaching Solution | | |
| Sodium Ethylenediamine-tetraacetato Ferrate Trihydrate | 100.0 | 120.0 |
| Disodium Ethylenediamine-tetraacetate | 10.0 | 11.0 |
| Ammonium Bromide | 140.0 | 160.0 |
| Ammonium Nitrate | 30.0 | 35.0 |
| Ammonia Water (27%) | 6.5 ml | 4.0 ml |
| Add Water to make | 1.0 liter | 1.0 liter |
| pH | 6.0 | 5.7 |
| Fixing Solution | | |
| Disodium Ethylenediamine-tetraacetate | 0.5 | 0.7 |
| Sodium Sulfite | 7.0 | 8.0 |
| Sodium Bisulfite | 5.0 | 5.5 |
| Aqueous Solution of Ammonium Thiosulfate (70%) | 170.0 ml | 200.0 ml |
| Add Water to make | 1.0 liter | 1.0 liter |
| pH | 6.7 | 6.6 |
| Stabilizing Solution | | |
| Formalin (37%) | 2.0 ml | 3.0 ml |
| Polyoxyethylene p-Monononyl-phenyl Ether (an average degree of polymerization: 10) | 0.3 | 0.45 |
| Disodium Ethylenediamine-tetraacetate | 0.05 | 0.08 |
| Add Water to make | 1.0 liter | 1.0 liter |
| pH | 5.0 to 8.0 | 5.8 to 8.0 |

As is apparent from the results of Table 4, the combinations of the present invention effectively inhibit changes in sensitivity after exposure (latent image sensitivity modification), and in addition, can also inhibit a reduction in sensitivity due to oxygen.

EXAMPLE 4

A multi-layer color photographic paper having the following layer constitution on a paper support laminated with polyethylene on both sides were produced. Coating solutions were prepared in the following manner.

Preparation of Coating Solution for First Layer:

To 19.1 g of yellow coupler (Ex-Y), 4.4 g of color image stabilizer (Cpd-1), and 1.4 g of color image stabilizer (Cpd-7) were added 27.2 ml of ethyl acetate and 8.2 g of solvent (Solv-1) to dissolve them. The resulting solution was emulsified and dispersed into 185 ml of a 10% aqueous solution of gelatin containing 8 ml of a 10% aqueous solution of dodecylbenzensulfonic acid. On the other hand, blue-sensitive sensitizing dyes (Dye- 1 and Dye-2) shown below were added to a silver chlorobromide emulsions which was prepared according to the examples described in, for example, JP-A-1-198,743, JP-A-2-42, JP-A-2-129,628 (cubic, a 3:7 mixture (silver molar ratio) of an emulsion having a mean grain size of 0.88 μm and an emulsion having a mean grain size of 0.70 μm, coefficients of variation in grain size distribution for the respective emulsions being 0.08 and 0.10, each emulsion containing 0.2 mol % of silver bromide localized on surfaces of the grains) in amounts of $2.0\times10^{-4}$ mole per mole of silver, respectively, for the large-sized emulsion, and in amounts of $2.5\times10^{-4}$ mole per mole of silver, respectively, for small-sized emulsion, at 35° C. Thereafter sulfur sensitization was effected with triethylthiourea at 58° C. to obtain a silver chlorobromide emulsion.

TABLE 4

| | Sensitizing Dyes | | Hydrazones | | Relative Sensitivity | | |
|---|---|---|---|---|---|---|---|
| | | | | | Time Elapse | | |
| Sample No. | Compound No. | Amount | Compound No. | Amount | After Exposure | Time Elapse | Remarks |
| 3-1 | S-2 | 6.2 | — | — | 85 | 91 | |
| 3-2 | S-2 | 6.2 | H-3 | 4.0 | 85 | 91 | Comparison |
| 3-3 | S-2 | 6.2 | H-3 | 16.0 | 83 | 87 | Comparison |
| 3-4 | S-2 | 6.2 | II-11 | 4.0 | 85 | 89 | Comparison |
| 3-5 | S-2 | 6.2 | II-11 | 16.0 | 85 | 87 | Comparison |
| 3-6 | X-35 | 4.5 | — | — | 89 | 72 | |
| 3-7 | X-35 | 4.5 | H-3 | 4.0 | 89 | 72 | Comparison |
| 3-8 | X-35 | 4.5 | H-3 | 16.0 | 83 | 69 | Comparison |
| 3-9 | X-35 | 4.5 | I-19 | 4.0 | 89 | 76 | Invention |
| 3-11 | X-35 | 4.5 | I-19 | 16.0 | 93 | 83 | Invention |
| 3-12 | X-35 | 4.5 | II-31 | 4.0 | 89 | 83 | Invention |
| 3-13 | X-35 | 4.5 | II-31 | 16.0 | 93 | 87 | Invention |
| 3-14 | X-35 | 4.5 | II-1 | 4.0 | 93 | 93 | Invention |
| 3-15 | X-35 | 4.5 | II-1 | 16.0 | 97 | 95 | Invention |
| 3-16 | X-35 | 4.5 | II-7 | 4.0 | 91 | 89 | Invention |
| 3-17 | X-35 | 4.5 | II-7 | 16.0 | 97 | 97 | Invention |
| 3-18 | X-17 | 4.5 | — | — | 91 | 85 | |
| 3-19 | X-17 | 4.5 | H-3 | 4.0 | 89 | 85 | Comparison |
| 3-20 | X-17 | 4.5 | H-3 | 16.0 | 85 | 85 | Comparison |
| 3-21 | X-17 | 4.5 | II-1 | 4.0 | 95 | 93 | Invention |
| 3-22 | X-17 | 4.5 | II-1 | 16.0 | 97 | 97 | Invention |
| 3-23 | X-17 | 4.5 | II-11 | 4.0 | 93 | 89 | Invention |
| 3-24 | X-17 | 4.5 | II-11 | 16.0 | 97 | 99 | Invention |
| 3-25 | X-17 | 4.5 | II-22 | 4.0 | 97 | 95 | Invention |
| 3-26 | X-17 | 4.5 | II-22 | 16.0 | 97 | 95 | Invention |

The above-described emulsified dispersion was mixed with this silver chlorobromide emulsion to prepare a coating solution for the first layer having the following composition.

Coating solutions for the second to the seventh layers were also prepared in a manner similar to that of the coating solution for the first layer. The sodium salt of 2-hydroxy-4, 6-dichloro-1,3,5-triazine was employed as a gelatin hardener for the respective layer.

Sensitizing dyes shown in Table 5 were used in the fifth layer (cyan color forming layer). The added amounts shown in Table 5 are for the large-sized emulsions, and 1.25-fold amounts of the respective corresponding sensitizing dyes were also added for the small-sized emulsions. The concentrations of the sensitizing dyes and the hydrazone compounds added are the same as those in Example 1. The following spectral sensitizing dyes were employed for yellow and magenta color forming layers.

First Layer (Yellow Color Forming Layer):

Dye-1

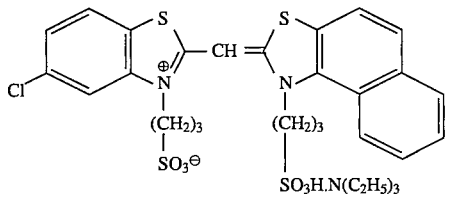

Dye-2

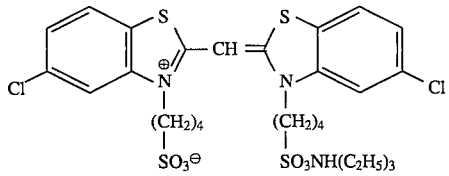

($2.0\times10^{-4}$ mol per mol of silver halide, for a large-sized emulsion, respectively, and $2.5\times10^{-4}$ mol per mol of silver halide, for a small-sized emulsion, respectively)

Third Layer (Magenta Color Forming Layer):

Dye-3

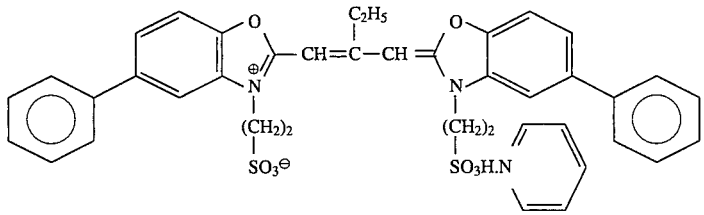

Dye-4

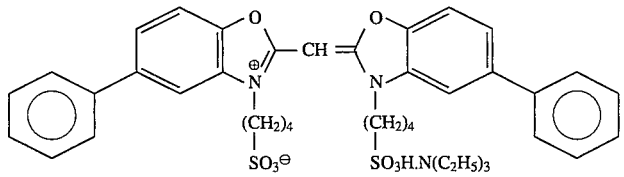

(The amount of Dye-3 is $4.0\times10^{-4}$ mol per mol of silver halide, for a large-sized emulsion, and $5.6\times10^{-4}$ mol per mol of silver halide, for a small-sized emulsion; and the amount of Dye-4 is $7.0\times10^{-5}$ mol per mol of silver halide, for a large-sized emulsion, and $1.0\times10^{-5}$ mol per mol of silver halide, for a small-sized emulsion.)

To the fifth layer (cyan color forming layer), disodium 4,4'-bis[2,4-(2-naphthyloxy)pyrimidine-6-ylamino]stilbene-2,2'-disulfonate was further added in an amount of $1.8\times10^{-3}$ mol per mol of silver halide. Furthermore, to all the respective color forming layers, 1-(5-methylureidophenyl)-5-mercaptotetrazole was added in an amount of $8.0\times10^{-4}$ mol per mol of silver halide.

For preventing irradiation, to the emulsion layer were added disodium 2-[3-(2-hydroxyethylcarbamoyl)- 4-(5-(5-hydroxy-3-(2-hydroxyethylcarbamoyl) 1-(2-sulfobenzyl)-5-pyrazolyl)-2,4-pentadienylidene)-5-pyrazolon- 1-ylmethyl] benzenesulfonate, tripotassium 4-[3,3-dimethyl-5-sulfo-2-(7-((3,3-dimethyl-5-sulfo-1-(4-sulfobutyl)indolin-2-ylidene)-1,3,5-heptatrienyl)-3H-1-indolio]butane-sulfonate, and pentapotassium 4-(3,3-dimethyl- 4,6-disulfo-2-(7-((3,3-dimethyl-4,6-disulfo-1-( 4-sulfobutyl)benzo[e] indolin-2-ylidene]-1,3,5-heptatrienyl)- 3H-1-benzo[e] indolio)butanesulfonate dyes.

Layer Constitution:

The composition of each layer is denoted below. Numerals indicate coated amounts ($g/m^2$). For the silver halide emulsions, numerals indicate coated amounts cnverted to silver.

Support:

Paper laminated with polyethylene (polyethylene on the side of the first layer containing a white pigment ($TiO_2$) and a bluish dye (ultramarine))

| | |
|---|---|
| First Layer (Blue-Sensitive Yellow Color Forming Layer): | |
| Silver Chlorobromide Emulsion Described Above | 0.30 |
| Gelatin | 1.86 |
| Yellow Coupler (Ex-Y) | 0.82 |
| Color Image Stabilizer (Cpd-1) | 0.19 |
| Color Image Stabilizer (Cpd-7) | 0.06 |
| Solvent (Solv-1) | 0.35 |
| Second Layer (Color Mixing Preventing Layer): | |
| Gelatin | 0.99 |
| Color Mixing Inhibitor (Cpd-5) | 0.08 |
| Solvent (Solv-1) | 0.16 |
| Solvent (Solv-4) | 0.08 |
| Third Layer (Green-Sensitive Magenta Color Forming Layer): | |
| Silver Chlorobromide Emulsion (cubic, a 1:3 mixture (silver molar ratio) of an emulsion having a mean grain size of 0.55 μm and an emulsion having a mean grain size of 0.39 μm, coefficients of variation in grain size distribution for the respective emulsions being 0.10 and 0.08, respectively, each emulsion containing 0.8 mol % of silver bromide localized on surfaces of the grains) | 0.12 |
| Gelatin | 1.24 |
| Magenta Coupler (Ex-M) | 0.20 |
| Color Image Stabilizer (Cpd-2) | 0.03 |
| Color Image Stabilizer (Cpd-3) | 0.15 |
| Color Image Stabilizer (Cpd-4) | 0.02 |
| Color Image Stabilizer (Cpd-9) | 0.02 |
| Solvent (Solv-2) | 0.40 |
| Fourth Layer (Ultraviolet Light Absorbing Layer): | |
| Gelatin | 1.58 |
| Ultraviolet Light Absorber (UV-1) | 0.47 |
| Color Mixing Inhibitor (Cpd-5) | 0.05 |
| Solvent (Solv-5) | 0.24 |
| Fifth Layer (Red-sensitive or Infrared-Sensitive Cyan Color Forming Layer: | |
| Silver Chlorobromide Emulsion Described Above (cubic, a 1:4 mixture (silver molar ratio) of an emulsion having a mean grain size of 0.58 μm and an emulsion having a mean grain size of 0.45 μm, coefficients of variation in grain size distribution for the respective emulsions being 0.09 and 0.11, respectively, each emulsion containing 0.6 mol % of silver bromide localized on surfaces of the grains) | 0.23 |
| Gelatin | 1.34 |
| Cyan Coupler (Ex-C) | 0.32 |
| Color Image Stabilizer (Cpd-6) | 0.17 |
| Color Image Stabilizer (Cpd-7) | 0.40 |
| Color Image Stabilizer (Cpd-8) | 0.04 |
| Solvent (Solv-6) | 0.15 |
| Sixth Layer (Ultraviolet Light Absorbing Layer): | |
| Gelatin | 0.53 |
| Ultraviolet Light Absorber (UV-1) | 0.16 |
| Color Mixing Inhibitor (Cpd-5) | 0.02 |
| Solvent (Solv-5) | 0.08 |
| Seventh Layer (Protective Layer): | |
| Gelatin | 1.33 |
| Acrylic Modified Copolymer of Polyvinyl Alcohol (degree of modification: 17%) | 0.17 |
| Liquid Paraffin | 0.03 |

(ExY) Yellow Coupler:

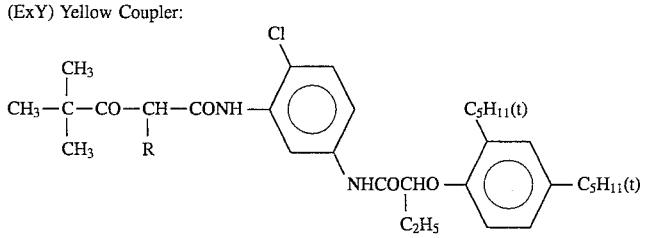

-continued
A 1:1 mixture (molar ratio) of
R = 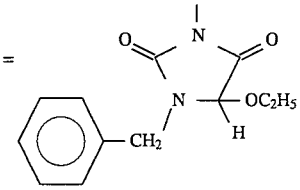 and R = 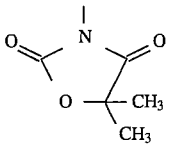
(ExM) Magenta Coupler:
A 1:1 mixture (molar ratio) of
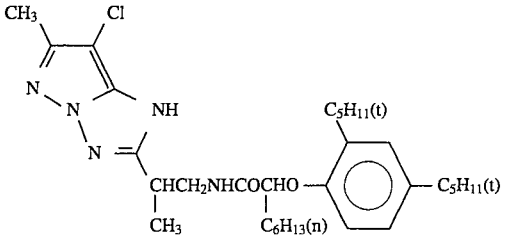
and
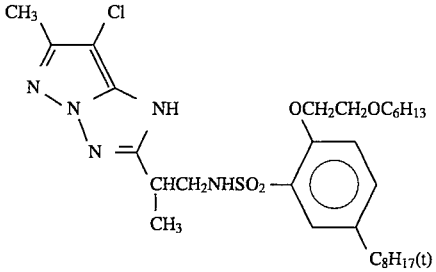
(ExC) Cyan Coupler:
A 2:4:4 mixture (weight ratio) of
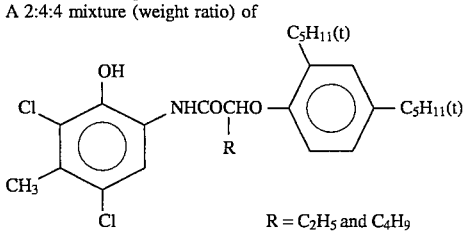
$R = C_2H_5$ and $C_4H_9$
and
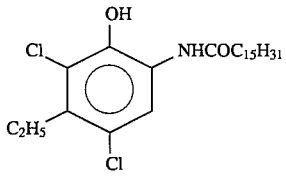
(Cpd-1) Color Image Stabilizer:
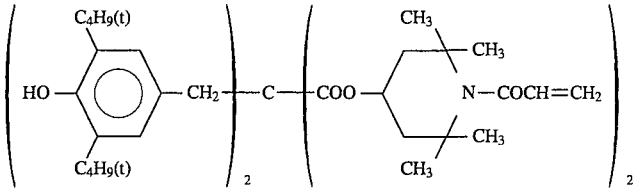

-continued
(Cpd-2) Color Image Stabilizer:
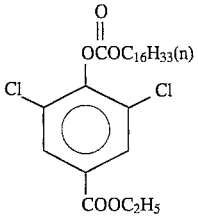
(Cpd-3) Color Image Stabilizer:
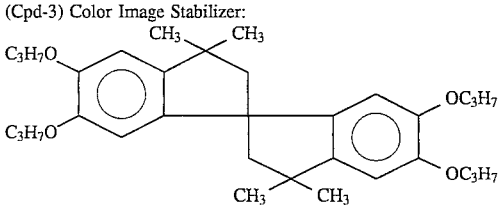
(Cpd-4) Color Image Stabilizer:
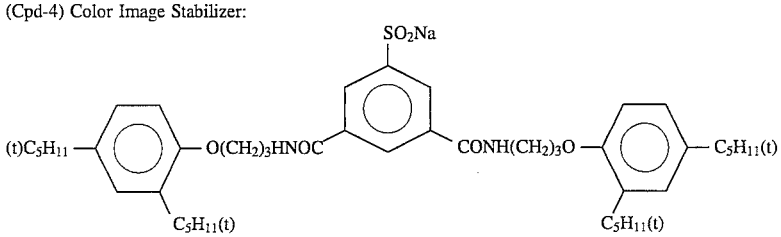
(Cpd-5) Color Mixing Inhibitor:
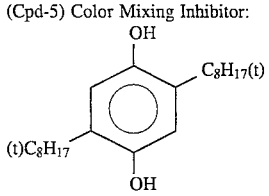
(Cpd-6) Color Image Stabilizer:
A 2:4:4 mixture (weight ratio) of
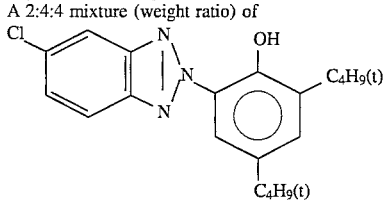
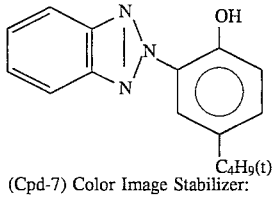
and
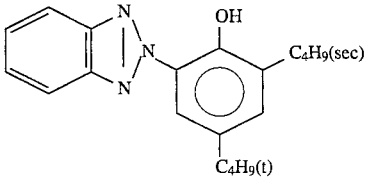
(Cpd-7) Color Image Stabilizer:
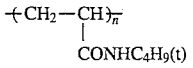
average molecular weight: 60,000

-continued
(Cpd-8) Color Image Stabilizer:
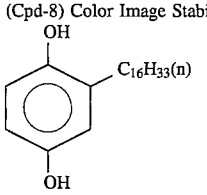
(Cpd-9) Color Image Stabilizer:
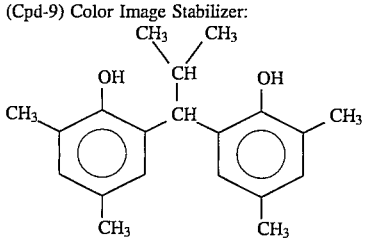
(UV-1) Ultraviolet Light Absorber:
A 4:2:4 mixture (weight ratio) of
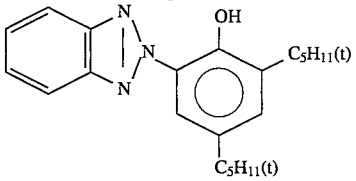
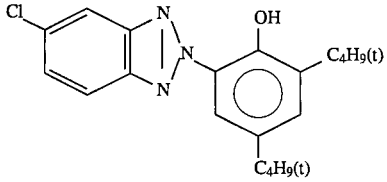
and
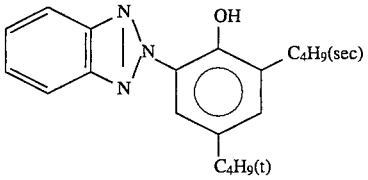
(Solv-1) Solvent:
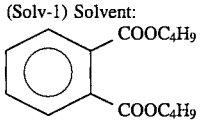
(Solv-2) Solvent:
A 2:1 mixture (volume ratio) of
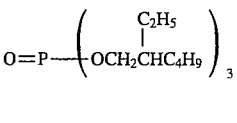
and
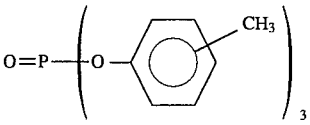
(Solv-3) Solvent:
$O{=}P{+}O{-}C_9H_{19}(iso))_3$
(Solv-4) Solvent:
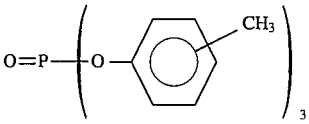
(Solv-5) Solvent:
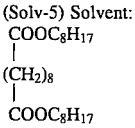

-continued (Solv-6) Solvent:

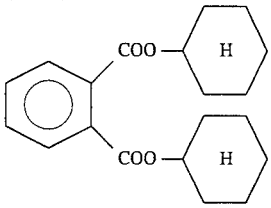

For the coated samples thus prepared, the fluctuation widths of the photographic sensitivity with changes in printing temperature (exposure temperature) and with natural storage were evaluated in the following manner.

For the purpose of evaluating the fluctuation widths of the photographic sensitivity with changes in printing temperature, the coated samples were kept at a temperature and a humidity of 15° C.-55% and 35° C.-55%, and exposed for 0.5 sec through an optical wedge and a red sharp cut filter SC-64 (which transmits the light of longer wavelength than about 620 nm), followed by development using the following developing stages and developer. On the other hand, in order to evaluate the fluctuation widths of the photographic sensitivity with natural storage, the coated samples were stored in a room for a period of 6 months. The samples were kept at a temperature and a humidity of 15° C.-55% prior to exposure, followed by similar exposure and development.

The reflection density of cyan of the treated samples thus prepared which was passed through a red filter was determined to obtain characteristic curves. For the evaluation of the fluctuation widths of the photographic sensitivity (SR) with changes in printing temperature, changes in density [ΔD (temperature)] between the samples exposed at 35° C.-55% and the corresponding samples exposed at 15° C.-55% with the following exposure amount were determined. The exposure amount which gave density 1.0 to the samples exposed at 15° C.-55% was also applied to the corresponding samples exposed at 35° C.-55%. The results are shown in Table 5. In order to evaluate the fluctuation widths of the photographic sensitivity with natural storage, changes in density [ΔD (wit time)] between the samples naturally stored and the corresponding samples sealed in argon gas and stored in a refrigerator at −30° C. for the same period were determined. The samples were exposed with an exposure amount which gave density 1.0 to the corresponding samples exposed at 15° C.-55%. The results are also shown in Table 5.

| Processing Stage | Temperature | Time |
|---|---|---|
| Color Development | 35° C. | 45 sec |
| Bleach-Fixing | 30–35° C. | 45 sec |
| Rinsing (1) | 30–35° C. | 20 sec |
| Rinsing (2) | 30–35° C. | 20 sec |
| Rinsing (3) | 30–35° C. | 20 sec |
| Drying | 70–80° C. | 60 sec |

(Three-tank countercurrent system from rinsing (3) to rinsing (1) was employed.)

The compositions of the respective baths were as follows:

| | (Tank Solution) |
|---|---|
| Color Developing Solution: | |
| Water | 800 ml |
| Ethylenediamine-N,N,N-tetra-methylenephosphonic acid | 1.5 g |
| Triethanolamine | 8.0 g |
| Sodium Chloride | 1.4 g |
| Potassium Carbonate | 25.0 g |
| N-Ethyl-N-(β-methanesulfonamido-ethyl)-3-methyl-4-aminoanilinium sulfate | 5.0 g |
| N,N-Bis(carboxymethyl)hydrazine | 5.5 g |
| Fluorescent Brightening Agent (WHITEX 4B, manufactured by Sumitomo Chemical Co. Ltd.) | 1.0 g |
| Water to make | 1,000 ml |
| pH (25° C.) | 10.05 |
| Bleach-Fixing Solution: | |
| Water | 800 ml |
| Ammonium Thiosulfate (70%) | 100 ml |
| Sodium Sulfite | 17 g |
| Ethylenediaminetetraacetic Acid Fe (III) Ammonium | 55 g |
| Disodium Ethylenediamine-tetraacetate | 5 g |
| Ammonium Bromide | 40 g |
| Water to make | 1,000 ml |
| pH (25° C.) | 6.0 |
| Rinsing Solution: | |
| Ion-Exchanged water (the content of each of calcium and magnesium is 3 ppm or less) | |

TABLE 5

| Sample No. | Sensitizing Dyes Compound No. | Sensitizing Dyes Amount | Hydrazones Compound No. | Hydrazones Amount | ΔD (Temperature) | ΔD (Time Elapse) | Remarks |
|---|---|---|---|---|---|---|---|
| 4-1 | X-13 | 3.2 | — | — | 0.08 | −0.09 | |
| 4-2 | X-13 | 3.2 | H-3 | 3.0 | 0.08 | −0.09 | Comparison |
| 4-3 | X-13 | 3.2 | H-3 | 15.0 | 0.09 | −0.10 | Comparison |
| 4-4 | X-13 | 3.2 | II-11 | 3.0 | 0.04 | −0.05 | Invention |
| 4-5 | X-13 | 3.2 | II-11 | 15.0 | 0.02 | −0.02 | Invention |
| 4-6 | X-13 | 3.2 | II-22 | 3.0 | 0.02 | −0.03 | Invention |
| 4-7 | X-13 | 3.2 | II-22 | 15.0 | 0.01 | −0.01 | Invention |
| 4-8 | X-39 | 1.2 | — | — | 0.28 | −0.11 | |
| 4-9 | X-39 | 1.2 | H-3 | 3.0 | 0.29 | −0.10 | Comparison |
| 4-10 | X-39 | 1.2 | H-3 | 15.0 | 0.29 | −0.11 | Comparison |
| 4-11 | X-39 | 1.2 | I-20 | 3.0 | 0.09 | −0.05 | Invention |
| 4-12 | X-39 | 1.2 | I-20 | 15.0 | 0.04 | −0.04 | Invention |
| 4-13 | X-39 | 1.2 | II-22 | 3.0 | 0.05 | −0.04 | Invention |
| 4-14 | X-39 | 1.2 | II-22 | 15.0 | 0.03 | −0.03 | Invention |
| 4-15 | X-45 | 0.3 | — | — | 0.36 | −0.16 | |
| 4-16 | X-45 | 0.3 | H-3 | 3.0 | 0.33 | −0.16 | Comparison |
| 4-17 | X-45 | 0.3 | H-3 | 15.0 | 0.32 | −0.15 | Comparison |
| 4-18 | X-45 | 0.3 | II-7 | 3.0 | 0.19 | −0.09 | Invention |
| 4-19 | X-45 | 0.3 | II-7 | 15.0 | 0.06 | −0.04 | Invention |
| 4-20 | X-45 | 0.3 | II-22 | 3.0 | 0.11 | −0.06 | Invention |
| 4-21 | X-45 | 0.3 | II-22 | 15.0 | 0.04 | −0.04 | Invention |

As is apparent from Table 5, the combinations of the present invention significantly reduces fluctuations of density with changes in temperature on exposure, and further significantly decreases a reduction in density during natural storage.

The results of examples 1, 2, 3 and 4 show that the combinations of the hydrazone compounds and the sensitizing dyes of the present invention can provide the silver halide photographic materials in which the fluctuations of density with changes in temperature on exposure and further a reduction in density during storage are significantly reduced.

While the present invention has been described in detail and with reference to specific embodiments thereof, it is apparent to one skilled in the art that various changes and modifications can be made therein without departing from the spirit and the scope of the present invention.

What is claimed is:

1. A silver halide photographic material comprising a support having thereon at least one silver halide emulsion layer, wherein the silver halide emulsion layer contains at least one compound represented by the following formula (II) and at least one compound represented by the following formula (X):

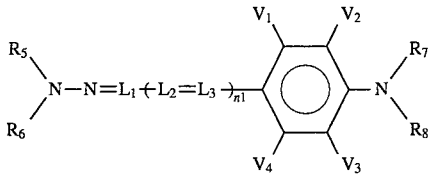

(II)

wherein $R_5$ and $R_6$ are the same or different and each represents an aliphatic group, an aryl group or a heterocyclic group; $R_7$ and $R_8$ are the same or different and each represents a hydrogen atom, an alkyl group, an aryl group or a heterocyclic group; $V_1$, $V_2$, $V_3$ and $V_4$ are the same or different and each represents a hydrogen atom, an alkyl group, an aryl group, a heterocyclic group, a carboxyl group, a sulfo group, a cyano group, a halogen atom, a hydroxyl group, an alkoxycarbonyl group, an alkoxy group, an aryloxy group, an acyloxy group, an acyl group, a carbamoyl group, a sulfamoyl group, an amino group, an alkylthio group, an alkylsulfonyl group, an alkylsulfinyl group, a nitro group, a phosphoric acid group, an acylamino group, an ammonium group, a mercapto group, a hydrazino group, a ureido group, an imido group, or an unsaturated hydrocarbon group; $L_1$, $L_2$ and $L_3$ are the same or different and each represents a methine group; and $n_1$ represents 0 or 1;

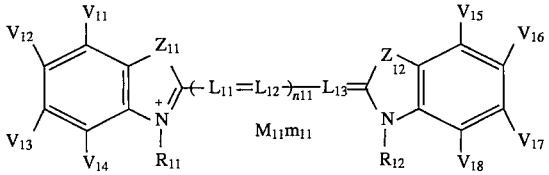

(X)

wherein $Z_{11}$ represents a sulfur atom, a selenium atom or a substituted nitrogen atom represented by

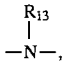

in which $R_{13}$ represents an alkyl group, an aryl group or a heterocyclic group; $Z_{12}$ represents a sulfur atom, a selenium atom, an oxygen atom or a substituted nitrogen atom represented by

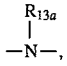

in which $R_{13a}$ has the same meaning as $R_{13}$; $R_{11}$ and $R_{12}$ are the same or different and each represents an alkyl group; $V_{11}$, $V_{12}$, $V_{13}$, $V_{14}$, $V_{15}$, $V_{16}$, $V_{17}$ and $V_{18}$ are the same or different and each represents a hydrogen atom, an alkyl group, an aryl group, a heterocyclic group, a carboxyl group, a sulfo group, a cyano group, a halogen atom, a hydroxyl group, an alkoxycarbonyl group, an alkoxy group, an aryloxy group, an acyloxy group, an acyl group, a carbamoyl group, a sulfamoyl group, an amino group, an alkylthio group, an alkylsulfonyl group, an alkylsulfinyl group, a nitro group, a phosphoric acid group, an acylamino group, an ammonium group, a mercapto group, a hydrazino group, a ureido group, an imido group, or an unsaturated hydrocarbon group; and adjacent two substituents thereof may be combined with each other to form a ring; $L_{11}$, $L_{12}$ and $L_{13}$ are the same or different and each represents a methine group; $n_{11}$ represents 1, 2 or 3; $M_{11}$ represents a counter ion for neutralizing charge; and $m_{11}$ is a number of 0 or more necessary for neutralizing the molecular charge.

2. The silver halide photographic material as claimed in claim 1, wherein $Z_{11}$ and $Z_{12}$ are each selected from the group consisting of a sulfur atom and a nitrogen atom substituted by an alkyl group.

3. The silver halide photographic material as claimed in claim 1, wherein $R_{11}$ and $R_{12}$ are each selected from the group consisting of an unsubstituted alkyl group, a carboxyalkyl group and a sulfoalkyl group.

4. The silver halide photographic material as claimed in claim 1, wherein $n_{11}$ is 1 or 2.

5. The silver halide photographic material as claimed in claim 1, wherein $M_{11}$ is selected from the group consisting of an ammonium ion, an iodide ion and a p-toluenesulfonate ion.

6. The silver halide photographic material as claimed in claim 1, wherein $R_5$ and $R_6$ are each an alkyl group.

7. The silver halide photographic material as claimed in claim 1, wherein $R_7$ and $R_8$ are each selected from the group consisting of a hydrogen atom and an alkyl group.

8. The silver halide photographic material as claimed in claim 1, wherein $V_1$, $V_2$, $V_3$ and $V_4$ are each selected from the group consisting of an alkyl group and an alkoxy group.

9. The silver halide photographic material as claimed in claim 1, wherein $L_1$, $L_2$, $L_3$ are each an unsubstituted methine group.

10. The silver halide photographic material as claimed in claim 1, wherein $n_1$ is 0.

11. The silver halide photographic material as claimed in claim 1, wherein the compound represented by formula (II) is used in an amount of from $1\times10^{-6}$ to $5\times10^{-1}$ mol per mol of silver halide.

12. The silver halide photographic material as claimed in claim 1, wherein the compound represented by formula (X) is used in an amount of from $4\times10^{-8}$ to $8\times10^{-2}$ mol per mol of silver halide.

13. The silver halide photographic material as claimed in claim 1, wherein an amount ratio by mole of the compound represented by formula (X) to the compound represented by formula (II) is from 100/1 to 1/1000.

* * * * *